US009425531B2

(12) United States Patent
Luther et al.

(10) Patent No.: US 9,425,531 B2
(45) Date of Patent: Aug. 23, 2016

(54) STAGE PIN CONNECTOR

(71) Applicant: LEX Products Corporation, Shelton, CT (US)

(72) Inventors: Robert Luther, Chester, CT (US); Vincent Bove, Bethlehem, CT (US); Tyrone Mellon, Bridgeport, CT (US); Peter Deutsch, Novato, CA (US)

( * ) Notice: Subject to any disclaimer, the term of this patent is extended or adjusted under 35 U.S.C. 154(b) by 116 days.

(21) Appl. No.: 13/908,519

(22) Filed: Jun. 3, 2013

(65) Prior Publication Data

US 2013/0337684 A1 Dec. 19, 2013

Related U.S. Application Data

(60) Provisional application No. 61/654,570, filed on Jun. 1, 2012.

(51) Int. Cl.
*H01R 13/58* (2006.01)
*H01R 13/405* (2006.01)
*H01R 13/504* (2006.01)

(52) U.S. Cl.
CPC ..... *H01R 13/405* (2013.01); *H01R 13/504* (2013.01)

(58) Field of Classification Search
CPC ..... H01R 13/405; H01R 13/504
USPC ..... 439/135, 140, 604, 606
See application file for complete search history.

(56) References Cited

U.S. PATENT DOCUMENTS 4,704,091 A * 11/1987 Owens et al. ..... 439/281
4,854,894 A * 8/1989 Harrell ..... 439/606
5,647,751 A * 7/1997 Shulman et al. ..... 439/106

FOREIGN PATENT DOCUMENTS

DE 3330177 A1 * 4/1985

* cited by examiner

*Primary Examiner* — Khiem Nguyen
(74) *Attorney, Agent, or Firm* — Steven M McHugh

(57) ABSTRACT

An electrical connector having a connector top and a connector base is provided. The electrical connector further includes a contact carrier module, wherein the contact carrier module defines a module cavity and includes a module top opening communicated with a module bottom opening via the module cavity. Additionally, the electrical connector includes a electrical conductor located within the module cavity to be communicated with the module top opening and the module bottom opening and a connector housing, wherein the connector housing includes a pre-mold material and an outer-mold material, wherein the pre-mold material covers at least a portion of the contact carrier module and at least a portion of the electrical cable, and the outer-mold material covers the pre-mold material and the contact carrier module, such that the module top opening is uncovered.

31 Claims, 40 Drawing Sheets

Section A-A

Section D-D

Section B-B

Section C-C

Section A-A

Section C-C

Section B-B

STAGE PIN CONNECTOR

RELATED APPLICATIONS

This application claims priority to and benefit of the filing date of U.S. Provisional Patent Application Ser. No. 61/654,570, filed Jun. 1, 2012 and U.S. Design patent application Ser. No. 29/423,569, filed Jun. 1, 2012, the contents of both of which are incorporated by reference herein in their entireties.

FIELD OF THE INVENTION

The present invention relates generally to an electrical connector and more particularly to a stage pin connector which is configurable to have a retractable shroud.

BACKGROUND OF THE INVENTION

Stage pin connector assemblies are well known in the art and are mainly used in the entertainment industry, such as for studio and theatrical lighting applications. Because these stage pin assemblies are used in all different types of environments they are typically constructed from high-temperature, high impact resistant thermoset and phenolic materials. Referring to FIG. 1A, a typical stage pin connector assembly 100 in accordance with the prior art is shown. As can be seen, the stage pin connector assembly 100 typically includes a stage pin male connector 102 and a stage pin female connector 104 connected via conductor cable(s) 106, which includes a first power conductor cable, a second power conductor cable and a ground conductor cable. The stage pin male connector 102 may include two circuit conductor pins 108 and 112 and a ground pin 110. The stage pin female connector 104 may include two circuit conductor pin sockets 114 and 118, and a ground pin socket 116. The two circuit conductor pins 108 and 112 are connected to the two circuit conductor pin sockets 114 and 118, respectively via the first and second power conductor cables and the ground pin 110 is connected to the ground pin socket 116 via the ground conductor cable.

Unfortunately however, current stage pin connector designs have a number of disadvantages. One such disadvantage is that the pins on the stage pin male connector 102 extend away from the end of the connector body and are thereby exposed. This is undesirable for at least two reasons. First, cables such as these are typically used in areas and conditions where they can come into contact with heavy equipment, such as forklifts, sound equipment, etc. Accordingly, because the pins are exposed they are prone to damage, such as bending or scraping of the pins. If the pins are bent, or if the pins become scraped, then the damage to the pin may prevent the pin from securely and correctly making contact with a corresponding pin socket. Moreover, the pins used on the stage pin male connector 102 typically include a slot 103 that bisects the pin (See FIG. 1B) and that extends down at least a portion of the pin. If the pin gets compressed under a heavy weight, one (or both) sides of the bisected portion of the pin slot may be bent inwards. Thus, the diameter of the pin may be decreased affecting the 'fit' of the pin into a corresponding pin socket. Second, the exposed nature of the pins used on the stage pin male connector 102 also presents a safety issue in that if the stage pin connector assembly is energized, a person touching (or becoming exposed to the pins via water or other conductant) the pins can be electrocuted (at worst) or shocked (at best). This also presents an issue regarding damaging of sensitive electrical equipment by presenting as a short circuit hazard.

Another disadvantage is that when the stage pin male connector 102 is connected to a female connector/device female inlet 104, the exposed nature of the pins present a different safety issue. Referring to FIG. 2, this is because if the stage pin male connector 102 is not completely pressed up against the stage pin female connector/inlet, a portion of the energized pins may be exposed. This presents an electrocution hazard to workers who may inadvertently touch the exposed portion directly or through other cabling. Furthermore, another disadvantage involves the wide body design of both the stage pin male connector 102 and the stage pin female connector 104 which are configured to fit securely and snugly together. This wide body design coupled with the secure and snug fit makes it physically difficult to separate the connectors when paired together. In order to separate the stage pin male connector 102 and the stage pin female connector 104, a person has to grab each connector with one hand and pull them apart. Unfortunately, the wide body design of the connectors (both male and female) makes it difficult for the average person to get a suitable handhold and pull the connectors with sufficient force to separate them. Accordingly, users typically then try to pull the connectors apart by the cables or try to pry the ends of the connectors apart. Pulling the connectors apart using the cables is undesirable because this puts stress on the wiring device terminations. Additionally, prying the ends of the connectors apart is undesirable because the pins and sockets are located on the ends of the connector and any inadvertent touching of an energized pin/socket could kill or hurt a user.

SUMMARY OF THE INVENTION

A Stage Pin connector having a connector top and a connector base is provided and includes a contact carrier module, wherein the contact carrier module defines a first module cavity, a second module cavity and a third module cavity and includes a first module top opening communicated with a first module bottom opening via the first module cavity, a second module top opening communicated with a second module bottom opening via the second module cavity and a third module top opening communicated with a third module bottom opening via the third module cavity. The Stage Pin connector also includes a first electrical conductor, a second electrical conductor and a third electrical conductor, wherein the first electrical conductor is located within the first module cavity to be communicated with the first module top opening and the first module bottom opening, the second electrical conductor is located within the second module cavity to be communicated with the second module top opening and the second module bottom opening and the third electrical conductor is located within the third module cavity to be communicated with the third module top opening and the third module bottom opening. Additionally, the Stage Pin connector includes a plurality of electrical cables each having a cable conductor, wherein each of the cable conductors is in electrical communication with at least one of the first electrical conductor, second electrical conductor and third electrical conductor via at least one of the first module bottom opening, second module bottom opening and third module bottom opening and a connector housing, wherein the connector housing includes a pre-mold material and an outer-mold material, wherein the pre-mold material covers at least a portion of the contact carrier module and at least a portion of the plurality of electrical cables, and the outer-mold material covers at least a portion of the plurality of electrical cables, the pre-mold material and the contact carrier module, such that the first module top opening, second module top opening and third module top opening are uncovered, wherein at least one of the pre-mold material and the outer-mold material forms a connector knob proximate the connector base and the plurality of electrical cables.

A Stage Pin connector is provided, wherein the stage pin connector includes a connector top and a connector base. The stage pin connector includes a contact carrier module, wherein the contact carrier module defines a first module cavity, a second module cavity and a third module cavity and includes a first module top opening communicated with a first module bottom opening via the first module cavity, a second module top opening communicated with a second module bottom opening via the second module cavity and a third module top opening communicated with a third module bottom opening via the third module cavity. Additionally, a first electrical conductor, a second electrical conductor and a third electrical conductor are provided, wherein the first electrical conductor is located within the first module cavity to be communicated with the first module top opening and the first module bottom opening, the second electrical conductor is located within the second module cavity to be communicated with the second module top opening and the second module bottom opening and the third electrical conductor is located within the third module cavity to be communicated with the third module top opening and the third module bottom opening. Moreover, a plurality of electrical cables each having a cable conductor may be provided, wherein each of the cable conductors is in electrical communication with at least one of the first electrical conductor, second electrical conductor and third electrical conductor via at least one of the first module bottom opening, second module bottom opening and third module bottom opening. Also, a connector housing is provided, wherein the connector housing includes an outer-mold material, wherein the outer-mold material covers at least a portion of the plurality of electrical cables and the contact carrier module, such that the first module top opening, second module top opening and third module top opening are uncovered.

In another embodiment an electrical connector is provided, wherein the electrical connector includes a connector top and a connector base. The electrical connector further includes a contact carrier module, wherein the contact carrier module defines a module cavity and includes a module top opening communicated with a module bottom opening via the module cavity. Additionally, the electrical connector includes a electrical conductor located within the module cavity to be communicated with the module top opening and the module bottom opening and a connector housing, wherein the connector housing includes a pre-mold material and an outer-mold material, wherein the pre-mold material covers at least a portion of the contact carrier module and at least a portion of the electrical cable, and the outer-mold material covers the pre-mold material and the contact carrier module, such that the module top opening is uncovered, wherein the connector housing forms a connector knob located proximate the connector base.

In still yet another embodiment, an electrical connector is provided wherein the electrical connector includes a connector top and a connector base, the electrical connector comprising, a contact carrier module, wherein the contact carrier module defines a module cavity and includes a module top opening communicated with a module bottom opening via the module cavity. The connector also includes an electrical conductor located within the module cavity to be communicated with the module top opening and the module bottom opening and a connector housing, wherein the connector housing includes an outer-mold material, wherein the outer-mold material covers the contact carrier module, such that the module top opening is uncovered, wherein the connector housing forms a handle portion located proximate the connector base.

In still yet another embodiment, a Stage Pin connector is provided and includes a contact carrier module, wherein the contact carrier module defines a module cavity and includes a module top opening communicated with a module bottom opening via the module cavity. The Stage Pin connector further includes a electrical conductor located within the module cavity to be communicated with the module top opening and the module bottom opening and an electrical cable having a cable conductor, wherein the cable conductor is in electrical contact with the electrical conductor via the module bottom opening. Furthermore, the Stage Pin connector includes a connector housing, wherein the connector housing includes a pre-mold material and an outer-mold material, wherein the pre-mold material covers at least a portion of the contact carrier module and at least a portion of the electrical cable, and the outer-mold material covers the pre-mold material and the contact carrier module, such that the module top opening is uncovered, wherein the connector housing forms a connector knob located proximate the electrical cable.

In still yet another embodiment, an electrical connector is provided and includes a contact carrier module, wherein the contact carrier module defines a module cavity and includes a module top opening communicated with a module bottom opening via the module cavity. The connector further includes a electrical conductor located within the module cavity to be communicated with the module top opening and the module bottom opening, an electrical cable having a cable conductor, wherein the cable conductor is in electrical contact with the electrical conductor via the module bottom opening and a connector housing, wherein the connector housing includes a pre-mold material and an outer-mold material, wherein the pre-mold material covers at least a portion of the contact carrier module and at least a portion of the electrical cable, and the outer-mold material covers the pre-mold material and the contact carrier module, such that the module top opening is uncovered, wherein the connector housing forms a connector knob located proximate the electrical cable.

BRIEF DESCRIPTION OF THE DRAWINGS

The foregoing and other features and advantages of the present invention will be better understood from the following detailed description of illustrative embodiments, taken in conjunction with the accompanying drawings in which.

DETAILED DESCRIPTION OF THE INVENTION

Figure 1A:
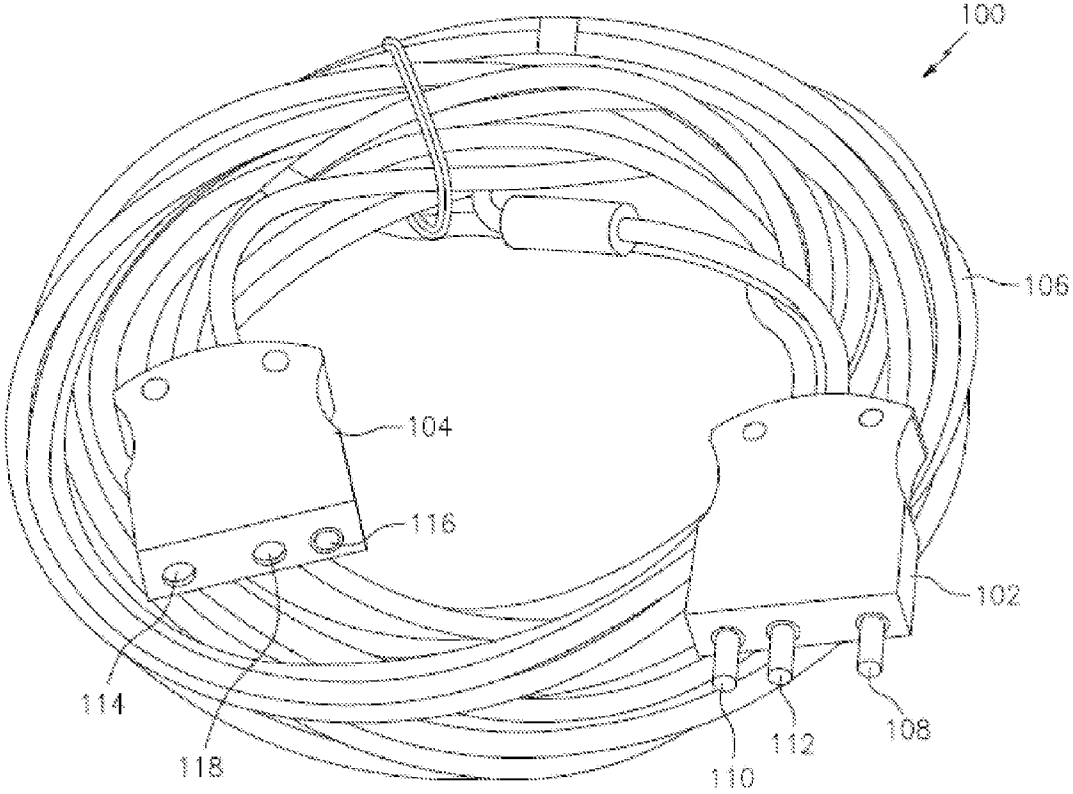
Figure 1A Prior Art
FIG. 1A is a top down perspective view of a stage pin connector assembly, in accordance with the prior art.
Figure 1B:
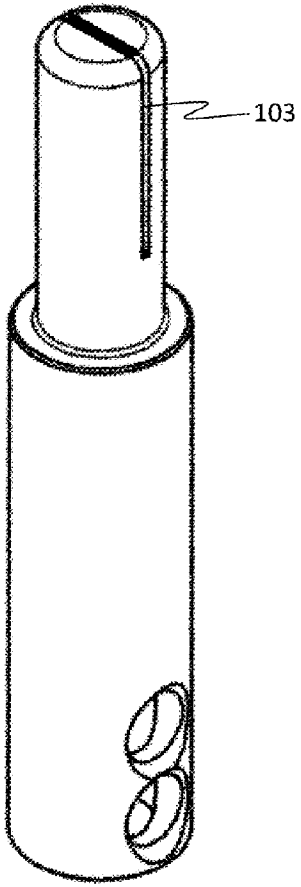
FIG. 1B is a side perspective view of a contact pin showing the slot that bisects the end of the pin.
Figure 2:
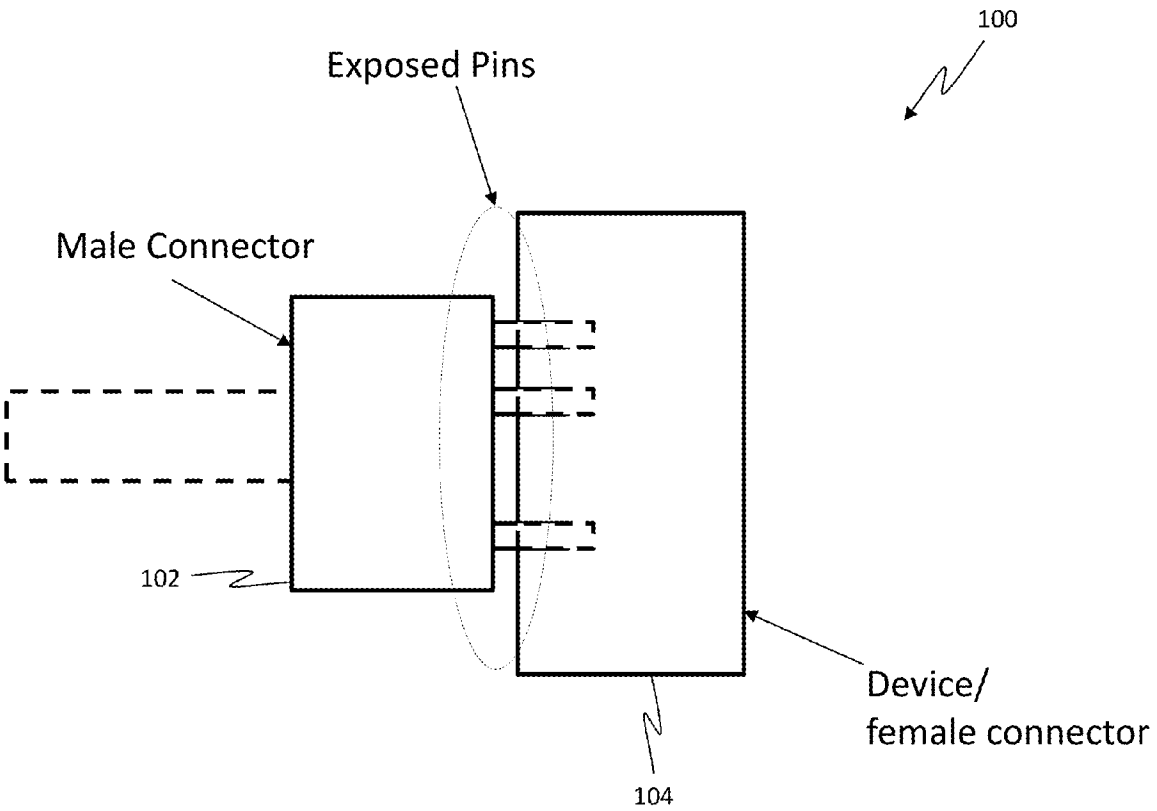
Figure 2 Prior Art
FIG. 2 is a top down view of a male stage pin plug associated with a female stage pin connector, in accordance with the prior art.
Figure 3A:
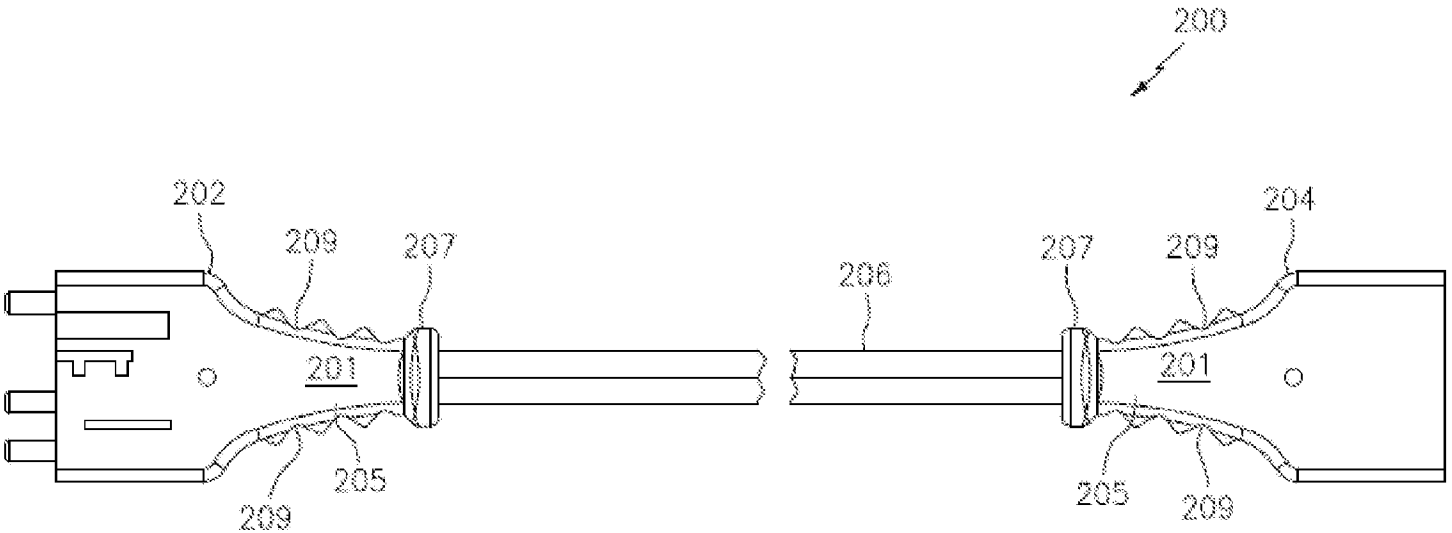
FIG. 3A is a side view of one embodiment a stage pin connector assembly without a retractable shroud, in accordance with the present invention.
Figure 3B:
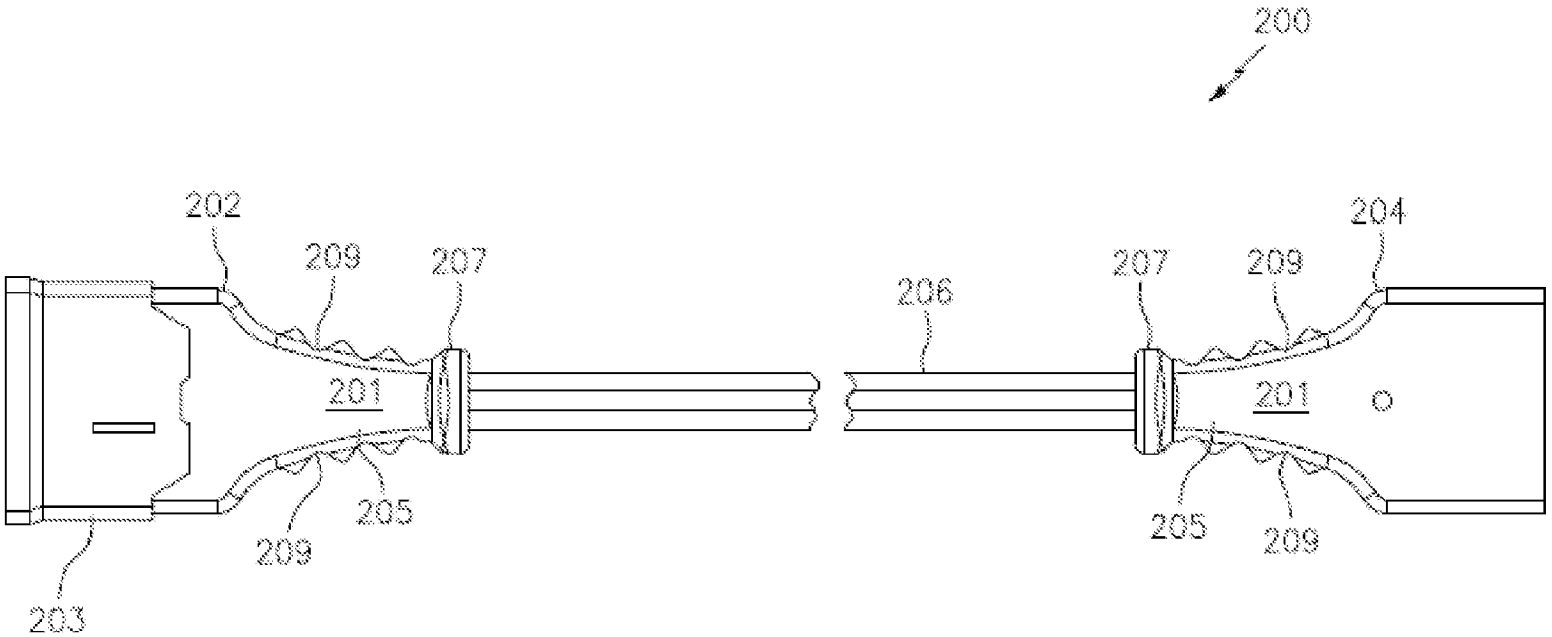
FIG. 3B is a side view of the stage pin connector assembly of FIG. 3A with a retractable shroud, in accordance with the present invention.

In accordance with the present invention, a stage pin connector assembly is disclosed herein, wherein the stage pin connector assembly includes a male stage pin connector conductively connected to a female stage pin connector via at least one cable. Referring to FIG. 3A and FIG. 3B, a stage pin connector assembly 200 is illustrated in accordance with an exemplary embodiment and includes a male stage pin connector 202 associated with a female stage pin connector 204 via a cable assembly 206, where the cable assembly 206 may include one or more conductors. The stage pin connectors 202, 204 include a handle portion 201 having a connector grip 205 and connector base 199 having a connector knob 207 It should be appreciated that the stage pin connector assembly 200 may or may not include a shroud 203 that may be fixed or retractable. FIG. 3A illustrates the stage pin connector assembly 200 without a shroud 203 and FIG. 3B illustrates the stage pin connector assembly 200 with a shroud 203.

Figure 4B:
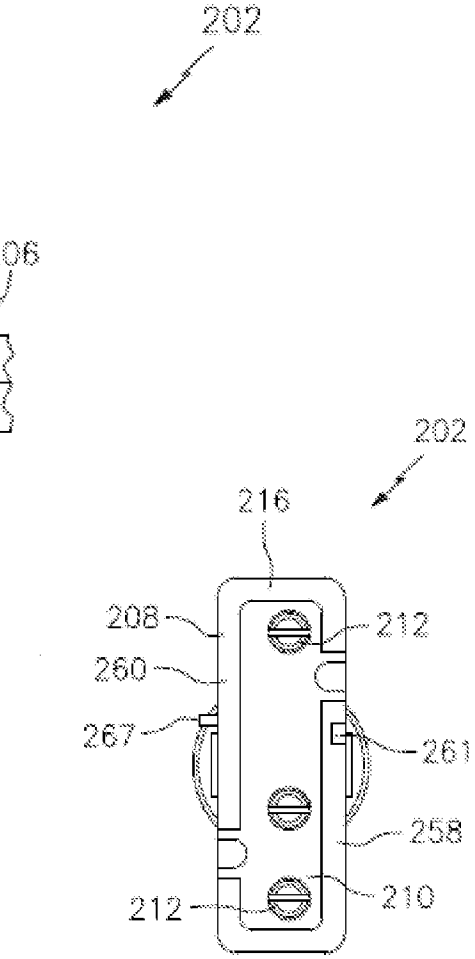
FIG. 4B is a front view of the male stage pin connector of FIG. 4A.
Figure 4A:
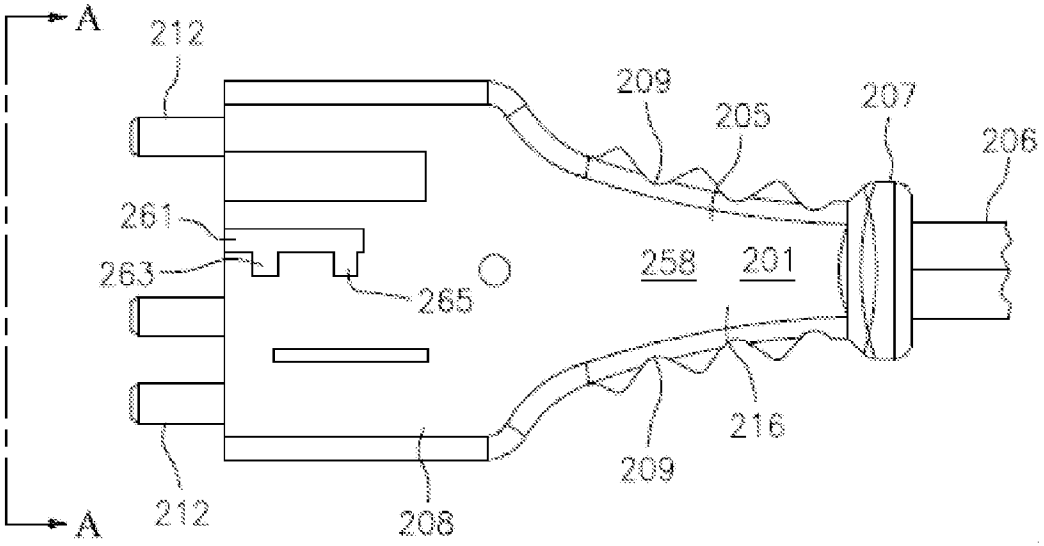
FIG. 4A is a side view of a male stage pin connector of the stage pin connector assembly of FIG. 3A.
Figure 4C:
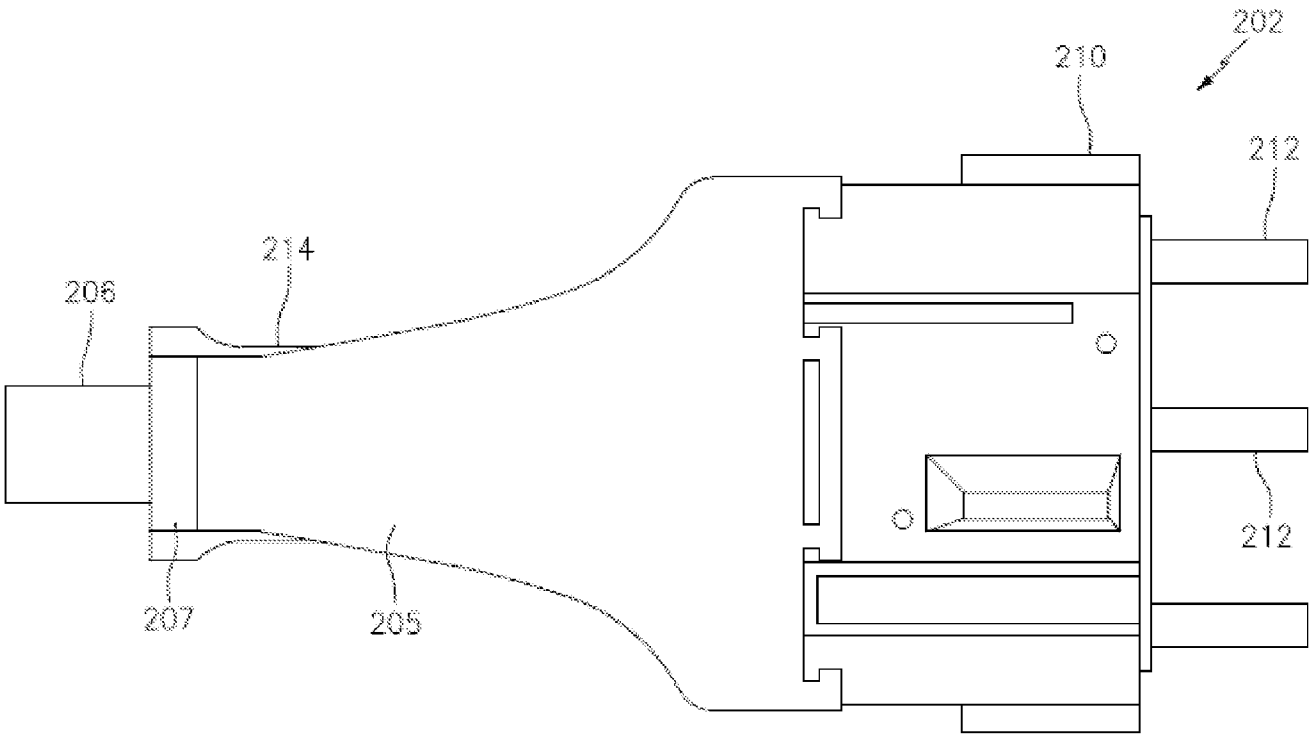
FIG. 4C is a side view of the male stage pin plug of FIG. 4A without the outer-mold component.

Referring to FIG. 4A, FIG. 4B and FIG. 4C, a male stage pin connector 202 is shown without a retractable shroud, wherein the male stage pin connector 202 includes a male connector housing 208, a male contact carrier module 210 and a plurality of contact pins 212. The male plug housing 208 is constructed from a pre-mold material 214 and a outer-mold material 216, where the pre-mold material 214 is configured to cover a portion of the male contact carrier module 210 (including 'cored out' regions 253) and a portion of the cable assembly 206, as shown in FIG. 4C. The male outer-mold material 216 is configured to cover the male pre-mold material 214 and the male contact carrier module 210, where the end of the male contact carrier module 210 from which the contact pins 212 extend may or may not be left uncovered by the male outer-mold material 216, as shown in FIG. 4B. It should be appreciated that although the male pre-mold material 214 and the male outer-mold material 216 are discussed herein as being molded materials, the male pre-mold material 214 and/or the male outer-mold material 216 may be replaced by a cover/material that is mechanically held together, such as by screws, clips, etc.

Referring to FIG. 5A, FIG. 5B, FIG. 5C and FIG. 5D, a male contact carrier module 210 which is configured for use with a connector having a shroud 203 in accordance with one embodiment of the invention, is shown and includes a male module body 218 having a male body top 220, a male body bottom 222, a male body front 224, a male body rear 226 and male body sides 228. The male body top 220 includes a male first top opening 230, a male second top opening 232 and a male third top opening 234. The male body bottom 222 includes a male first bottom opening 236, a male second bottom opening 238 and a male third bottom opening 240. The male module body 218 defines at least one module cavity which may include a male first cavity 242, a male second cavity 244 and a male third cavity 246, wherein the male first cavity 242 communicates the male first top opening 230 with the male first bottom opening 236, the male second cavity 244 communicates the male second top opening 232 with the male second bottom opening 238 and the male third cavity 246 communicates the male third top opening 234 with the male third bottom opening 240.

Figure 5A:
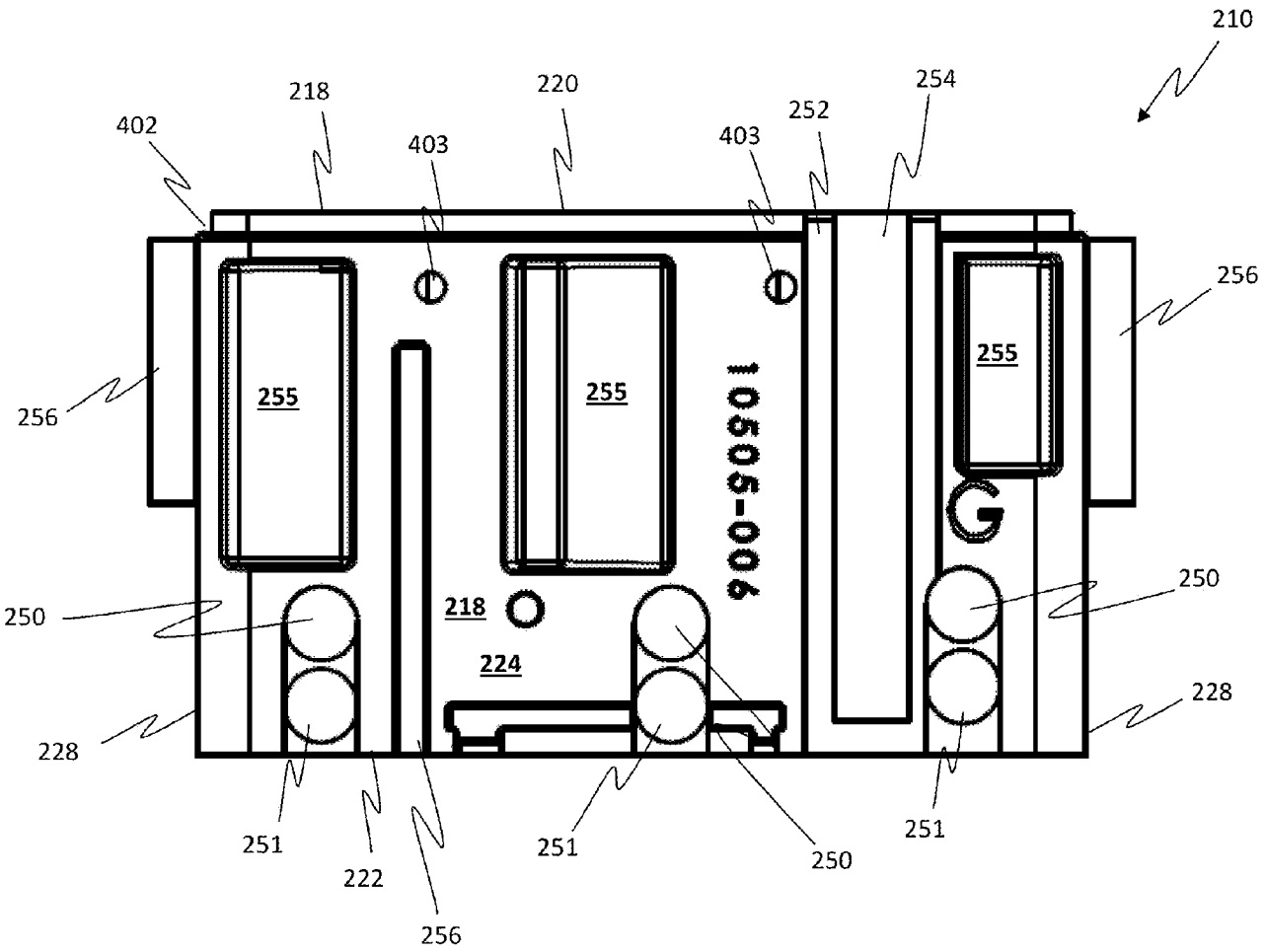
FIG. 5A is a side view of the male contact carrier module of the male stage pin connector of FIG. 4A.
Figure 5B:
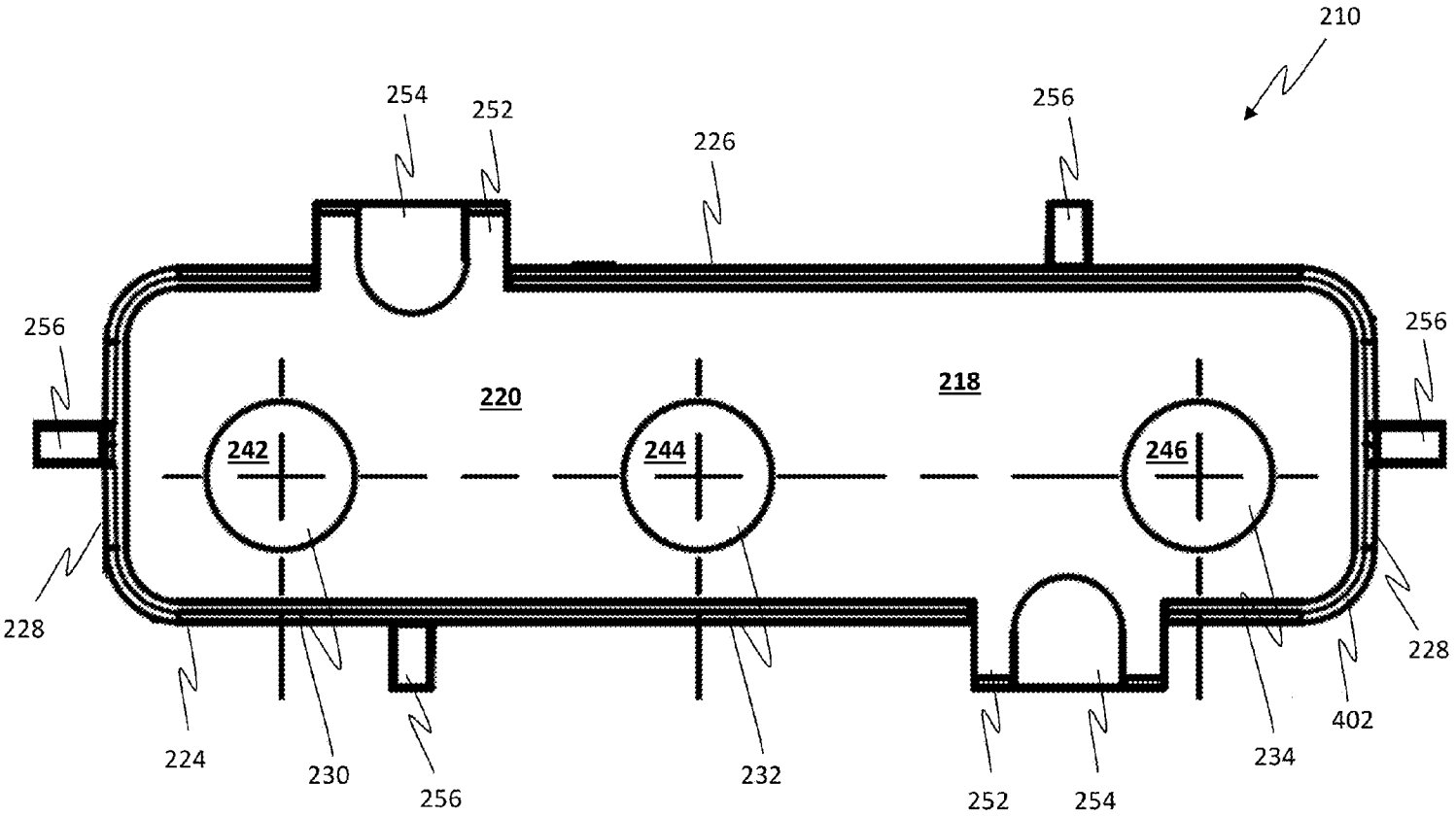
FIG. 5B is a top view of the male contact carrier module of FIG. 5A.
Figure 5C:
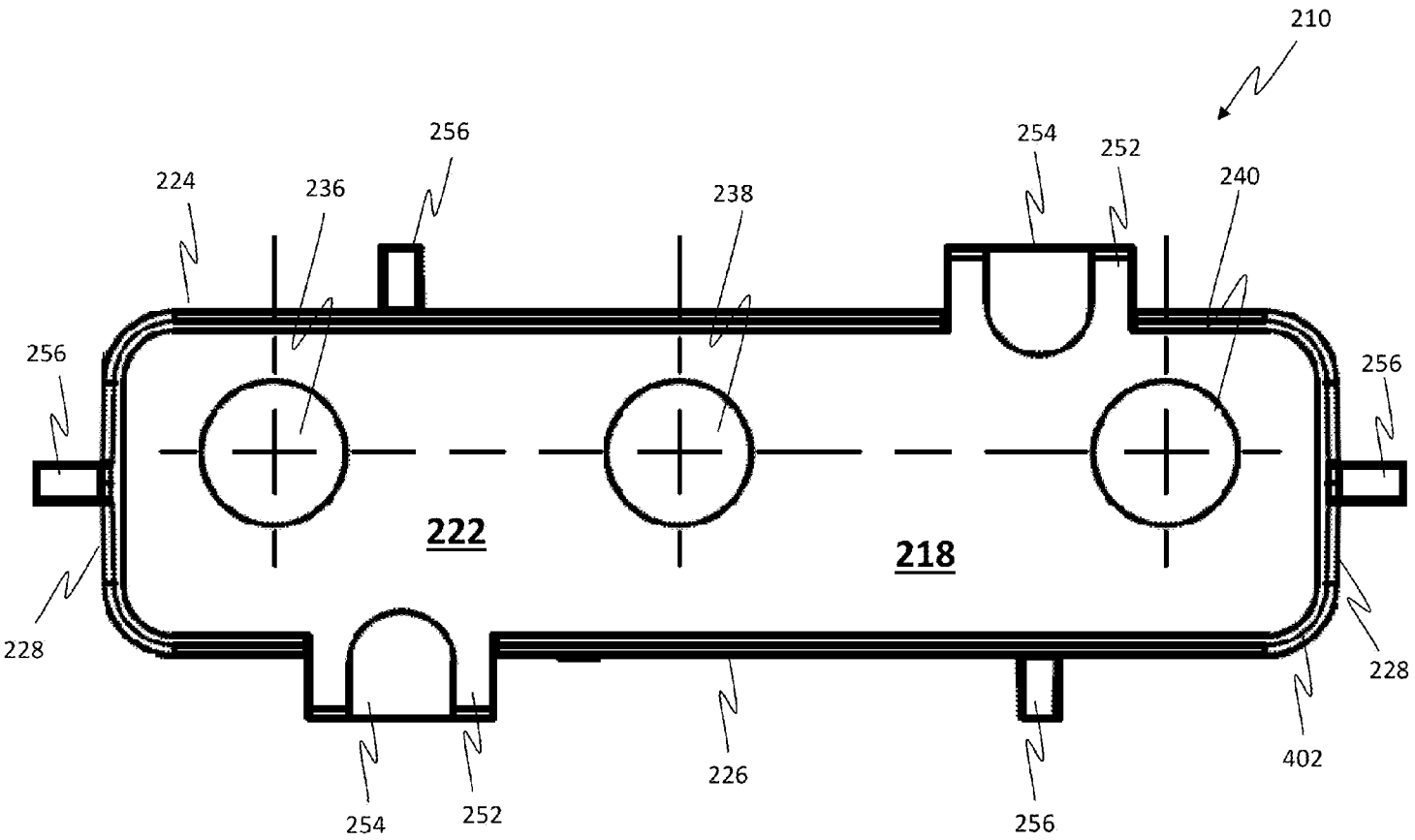
FIG. 5C is a bottom view of the male contact carrier module of FIG. 5A.
Figure 5D:
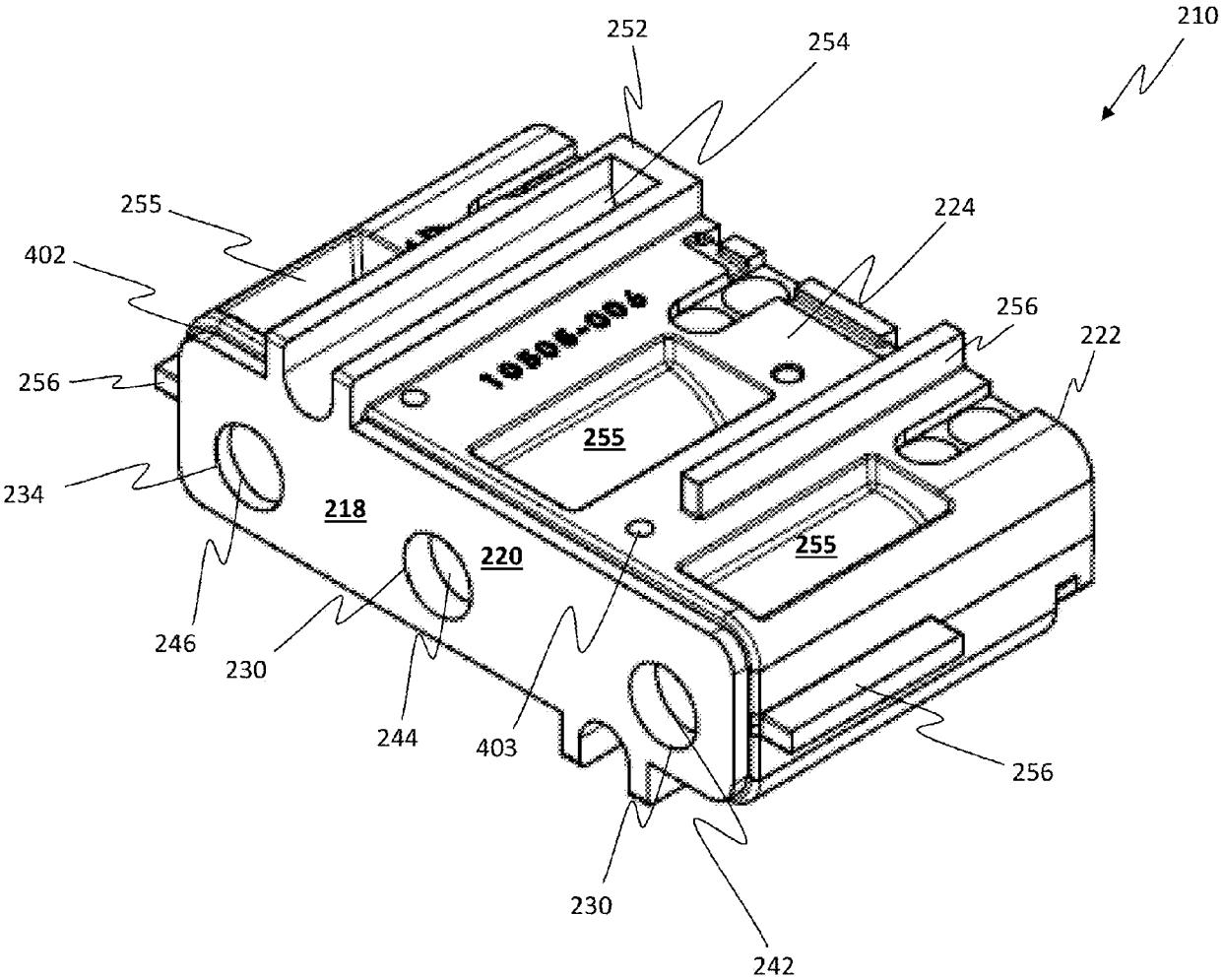
FIG. 5D is a side perspective view of the male contact carrier module of FIG. 5A.
Figure 5E:
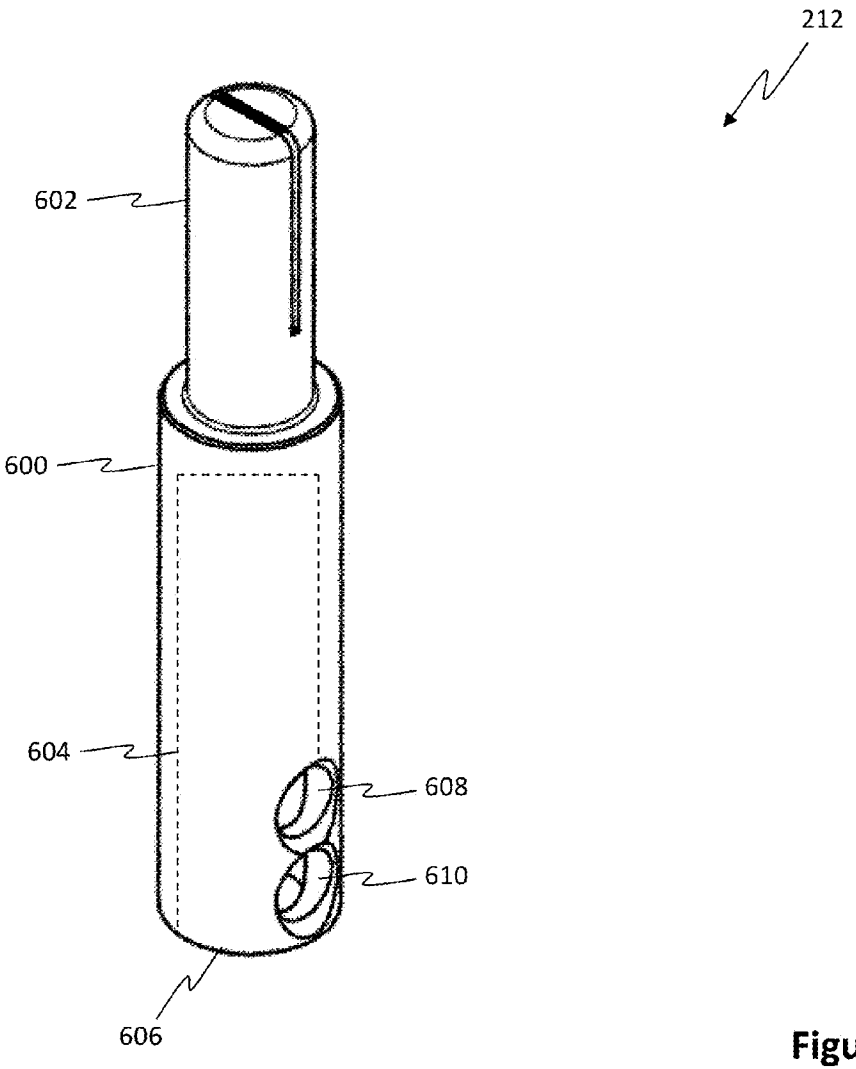
FIG. 5E is a side perspective view of a contact pin for use with the male connector housing of FIG. 5A.
Figure 5F:
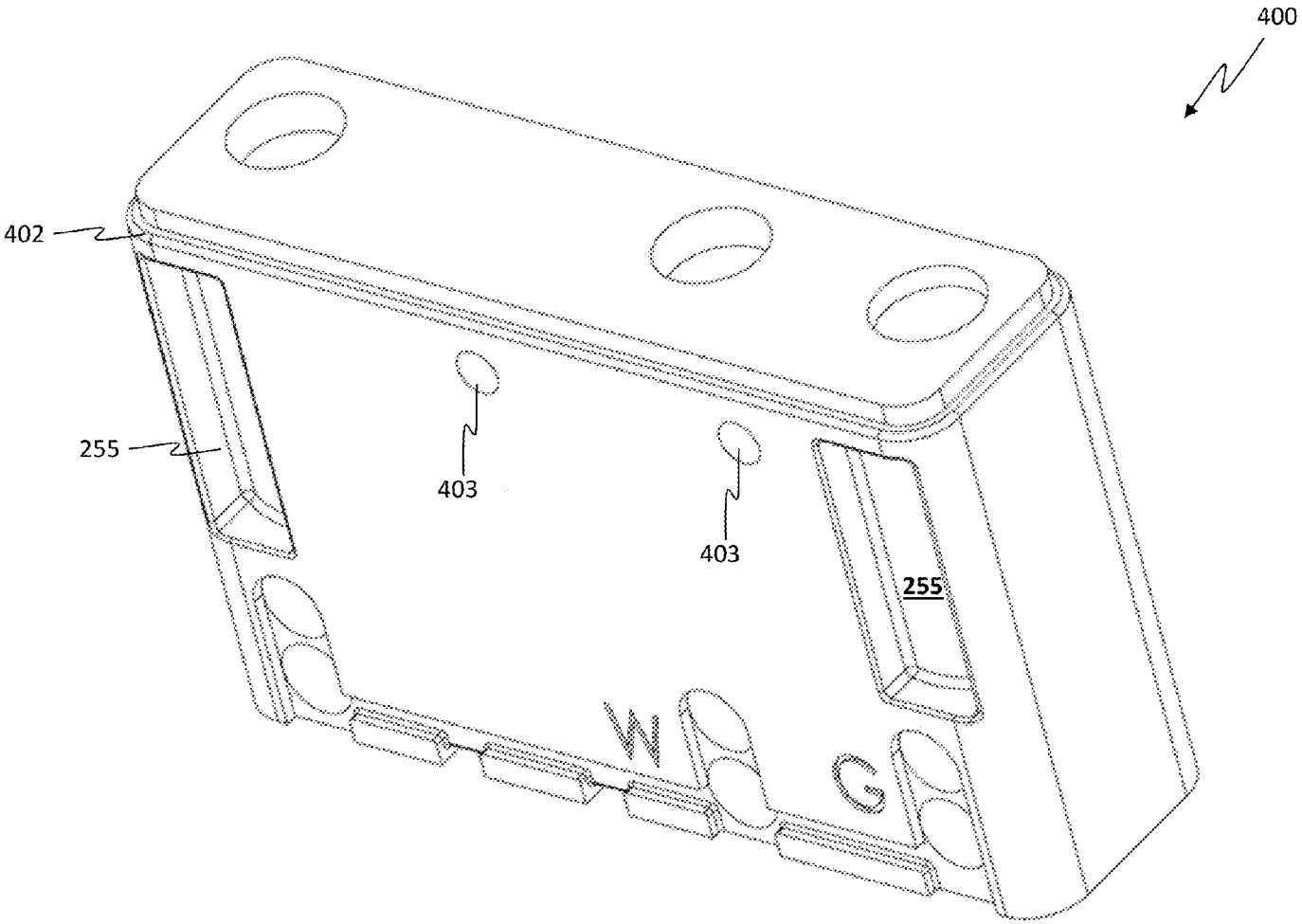
FIG. 5F is a side perspective view of a male contact carrier module, in accordance with another embodiment.
Figure 5G:
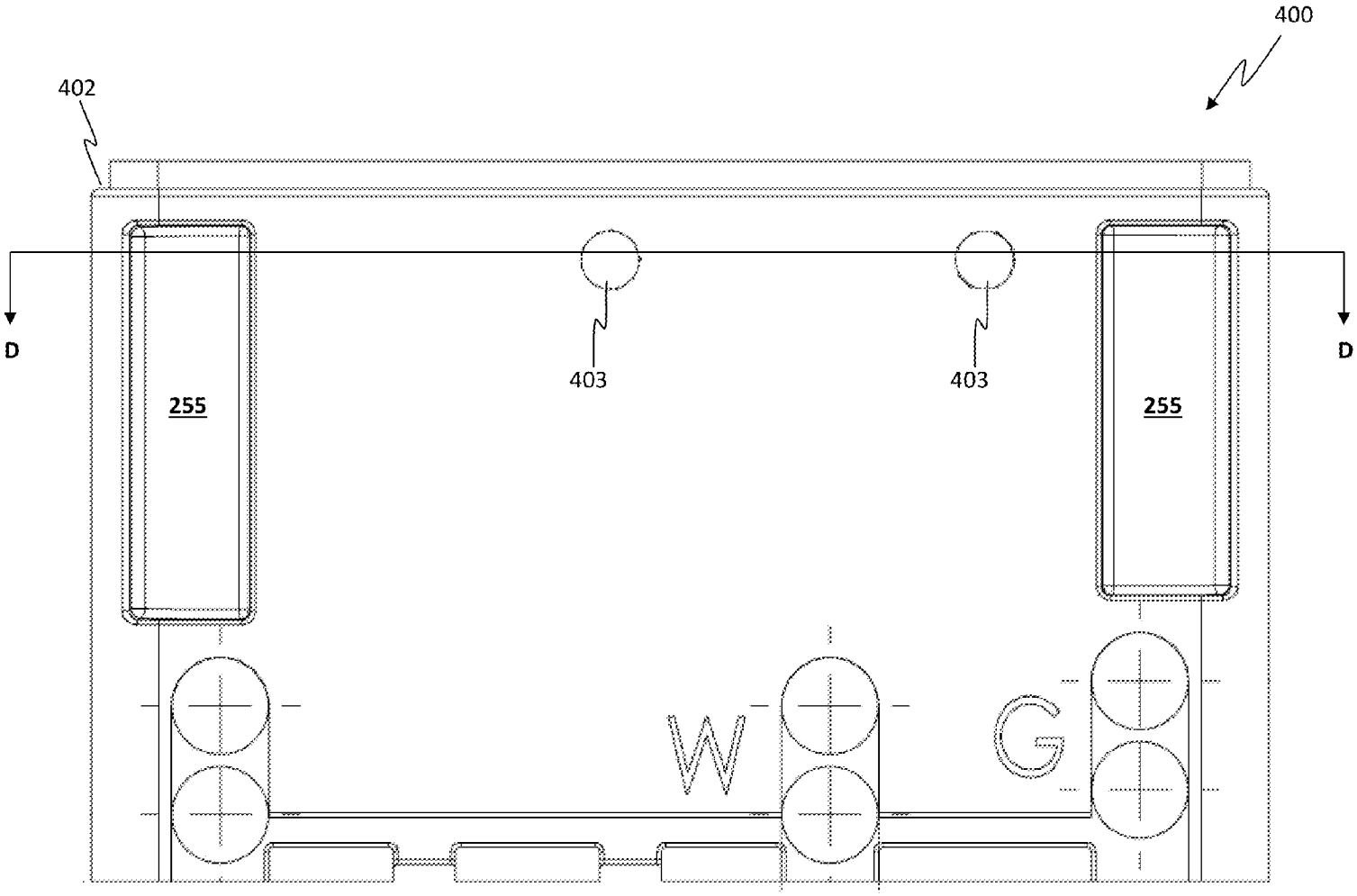
FIG. 5G is a side view of the male contact carrier module of FIG. 5E.
Figure 5H:
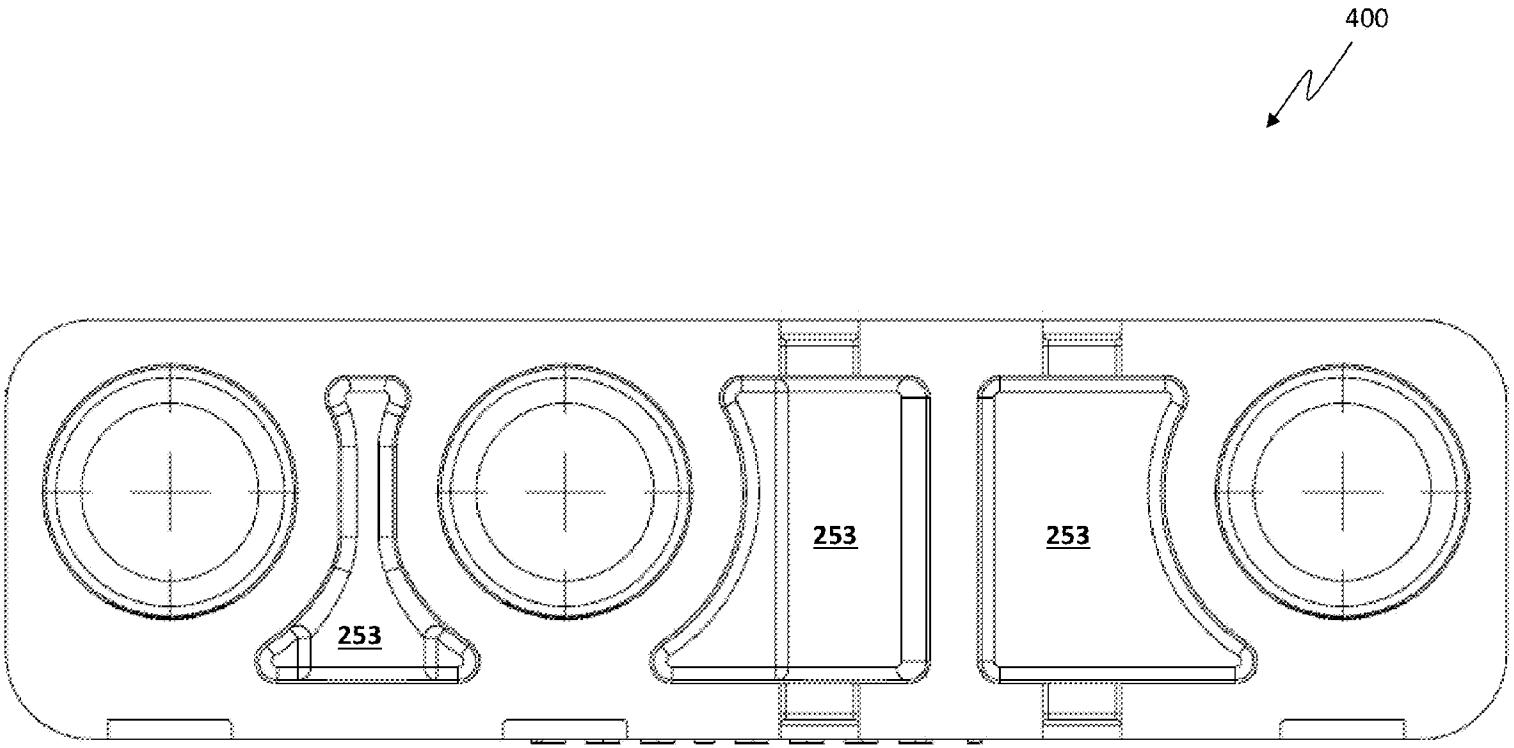
FIG. 5H is a bottom view of the male contact carrier module of FIG. 5E.
Figure 5J:
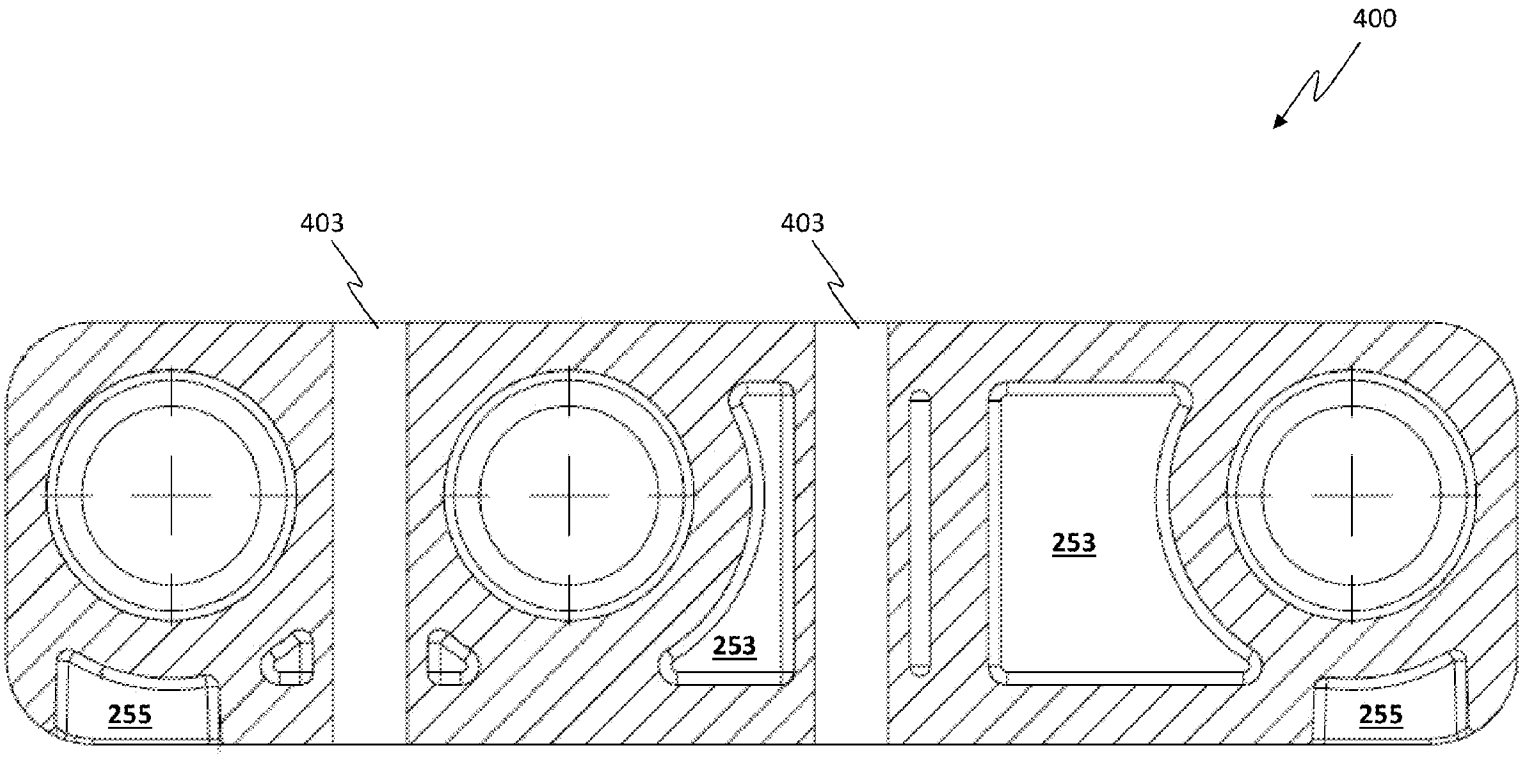
FIG. 5J is a top down sectional view of the male contact carrier module of FIG. 5E.

Additionally, in accordance with one embodiment of the invention the male body front 224 includes a plurality of first body openings 250 and a plurality of second body openings 251 which are located proximate the male body bottom 22 and which are communicated with the male first cavity 242, male second cavity 244 and male third cavity 246, wherein the plurality of first and second body openings 250, 251 are not threaded. Referring to FIG. 5E, one embodiment of a contact pin 212 is shown and includes a contact pin body 600 and a contact pin socket interface 602, wherein the contact pin socket interface 602 extends from the male connector to make electrical contact with a socket of a female connector or output/input port. The contact pin body 600 defines a contact pin body cavity 604 and includes a contact pin body bottom opening 606 which is communicated with the contact pin body cavity 604. Additionally, the contact pin body 600 further includes a first contact pin side opening 608 and a second contact pin side opening 610, each of which is communicated with the contact pin body cavity 604, wherein the first and second contact pin side openings 608, 610 are threaded.

Accordingly, when a contact pin 212 is inserted into the male first cavity 242, male second cavity 244 and male third cavity 246, the contact pin 212 can be securely contained therein by aligning the first body opening 250 with the first contact pin side opening 608 and the second body opening 251 with the second contact pin side opening 610 and inserting screws into the openings 250, 251 to engage the threaded portion of the first contact pin side opening 608 and/or second contact pin side opening 610. A cable may be associated with the contact pin body 600 by inserting the cable into the contact pin body cavity 604 via the contact pin body bottom opening 606 and rotating the screws contained in the first contact pin side opening 608 and/or second contact pin side opening 610 such that the screws extend into the contact pin body cavity 604 and compressingly interact with the cable to secure the cable therein. It should be appreciated that a conductive sleeve (such as a ferrule sleeve) may be used as an interface between the screw and the cable, wherein the screw compresses the sleeve onto the cable. This would allow the compressing force from the screw to be distributed over a larger portion of the cable to eliminate and/or reduce breaking of the individual wire strands of cable. It should be further appreciated that the sleeve may be associated directly with the cable prior to inserting the cable into the contact pin body cavity 604 or the sleeve may be located within the contact pin body cavity 604 prior to insertion of the cable. It should be appreciated that in accordance with the invention, other ways of securely containing the contact pins 212 and/or cables within the cavities 242, 244 and 246 are contemplated, such as using set screws and/or press fitting (i.e. friction fit) the contact pins 212 and/or cables into the cavities 242, 244 and 246. Moreover, the first and second body opening 250, 251 may be threaded and the first contact pin side opening 608 and a second contact pin side opening 610 may be unthreaded (or they both may be threaded).

Moreover, the male body front 224 and the male body rear 226 include a shroud guide structure 252 which extends from the surface of the male body front 224 and the male body rear 226 and which defines a shroud guide channel 254 which extends at least partially along the male body front 224 and the male body rear 226 between the male body top 220 and the male body bottom 222. Furthermore, it should be appreciated that the male module body 218 may also include one or more 'cored out' regions 253, cavities 255 and/or protrusions 256 located on the male body front 224, male body rear 226 and/or male body sides 228 to aid the male pre-mold material 214 and/or male outer-mold material 216 to more securely associate with the male module body 218. It should be appreciated that the openings 250, 251 may be threaded or unthreaded.

It is contemplated that the connector 202, 204 of the present invention may or may not include a shroud 203. Referring to FIG. 5F, FIG. 5G, FIG. 5H and FIG. 5J, a male contact carrier module 400 which is configured for use with a connector without a shroud 203, is shown in accordance with another embodiment of the invention.

Thus, as briefly described hereinabove, a contact pin 212 may be associated with the male contact carrier module 210 by locating the male contact pin 212 within the male first cavity 242 such that the contact pin socket interface 602 extends from the male body top 220 of the contact carrier module 210 and such that the first contact pin body side opening 608 and second contact pin body side opening 610 are aligned with the first and second body openings 250, 251, respectively. A first threaded mounting screw may be inserted into the first body opening 250 and the first contact pin body side opening 608 to engage with the threads on one (or both if both are threaded) of the first body opening 250 or the first contact pin body side opening 608. This secures the contact pin 212 within the male first cavity 242.

A conductor is inserted into the contact pin body bottom opening 606 such that the conductor is located within the contact pin body cavity 604 and a second threaded mounting screw may be inserted into the second body opening 251 and the second contact pin body side opening 610 to engage with the threads on one (or both if both are threaded) of the second body opening 251 and the second contact pin body side opening 610. In this embodiment, the second threaded mounted screw preferably extends into the contact pin body cavity 604 to compressingly engage a conductive sleeve which compresses against the conductor such that the conductor is securely contained within the contact pin body cavity 604. It is contemplated that one or both of the first and second mounting screws may be used to secure the conductor within the contact pin body cavity 604. This may repeated for each of the conductors that will be associated with the male contact carrier module 210. Moreover, although the connectors 202, 204 are shown as having only three conductors, other additional embodiments of the connector 202, 204 may include more or less conductors.

Figure 6:
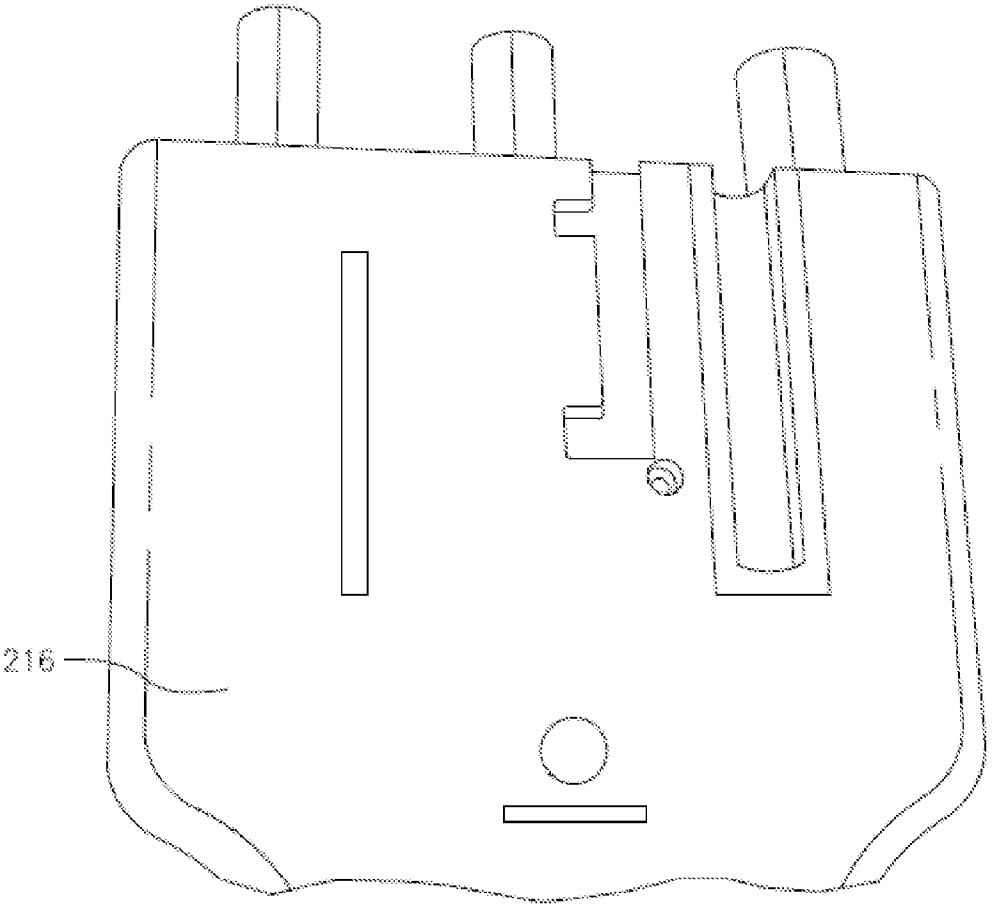
FIG. 6 is a side view of a male stage pin connector of the stage pin connector assembly of FIG. 3A.

Referring to FIG. 6 and again to FIG. 4A and FIG. 4B, the male outer-mold material 216 includes a male outer-mold material front 258 and a male outer-mold material rear 260, where the male outer-mold component front includes a shroud lock guide channel 261 having a first lock channel 263 located proximate one end of the shroud lock guide channel 261 and a second lock channel 265 located proximate the other end of the shroud lock guide channel 261. It should be appreciated that the male outer-mold component rear 260 also includes a shroud pin 267 which extends from the surface of the male outer-mold component rear 260 to interact with a shroud as discussed hereinafter.

Referring to FIG. 7A, FIG. 7B, FIG. 7C and FIG. 7D, it should be appreciated that a male stage pin connector shroud 203 may also be provided as desired and is sized and shaped to cover the end portion of the male stage pin connector 202 and at least a portion of the plurality of contact pins 212 extending therefrom. The male stage pin connector shroud 203 is resiliently and movably associated with the male stage pin connector 202 and includes a shroud body 266 defining a shroud cavity 268 and having a shroud front 270, a shroud rear 272 and shroud sides 274, wherein the shroud front 270 includes a shroud front outer surface 278 and a shroud front inner surface 280 and wherein the shroud rear 272 includes a shroud rear outer surface 282 and a shroud rear inner surface 284. The shroud front 270 includes a shroud front tab 285 located on the shroud front inner surface 280 and the shroud rear 272 includes a shroud rear tab 286 located on the shroud rear inner surface 278. Additionally, the shroud rear 272 defines a guide pin cavity 288 which communicates the shroud rear outer surface 282 with the shroud rear inner surface 284 and which extends vertically along a portion of the shroud rear 272. The shroud front 270 includes a shroud locking switch opening, a shroud locking switch 290, a connector locking member opening and a connector locking member 292. The shroud locking switch 290 includes a locking switch finger actuator 291 and a shroud lock tab 294. The shroud locking switch 290 is movably associated with the shroud front 270 via the shroud locking switch opening such that the locking switch finger actuator 291 is extending away from the shroud front outer surface 278 and the shroud lock tab 294 is extending away from the shroud front inner surface 280 into the shroud cavity 268. The shroud locking switch 290 is slidably configurable between a shroud lock first configuration and a shroud lock second configuration.

Figure 7B:
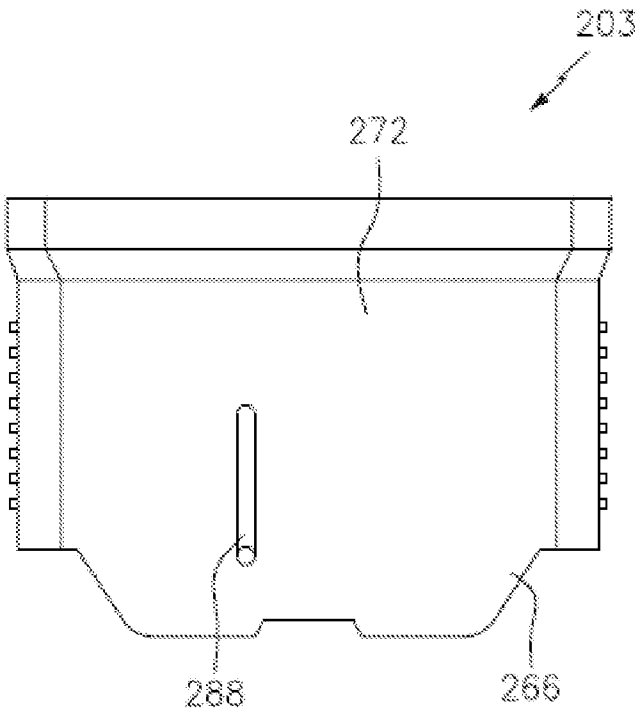
FIG. 7B is a rear view of the male stage pin plug shroud of FIG. 7A.
Figure 7A:
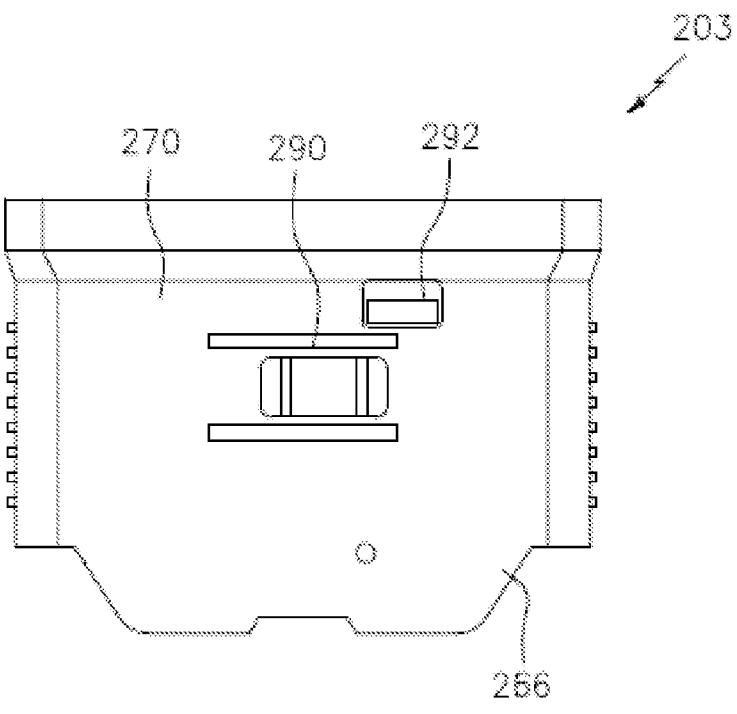
FIG. 7A is a front view of a male stage pin plug shroud of the stage pin connector assembly of FIG. 3B.
Figure 7D:
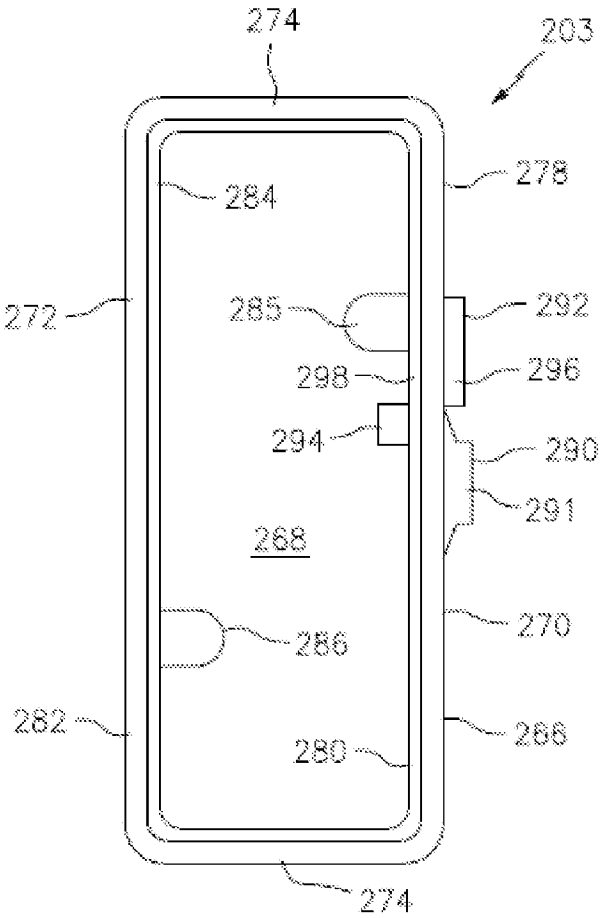
FIG. 7D is a bottom view of a male stage pin plug shroud of FIG. 7A.
Figure 7C:
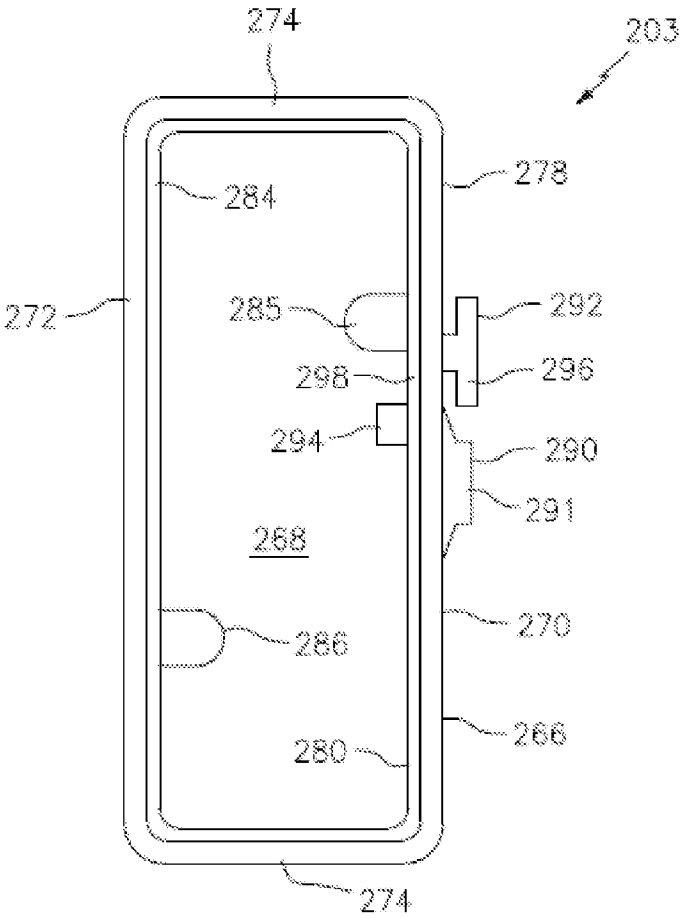
FIG. 7C is a top view of a male stage pin plug shroud of FIG. 7A.
Figure 8B:
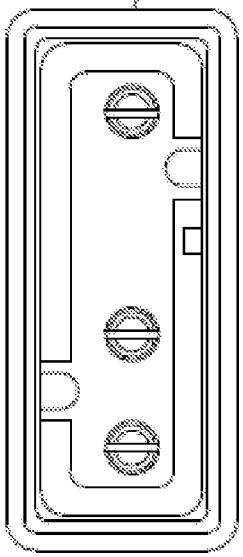
FIG. 8B is a top view of the male stage pin plug of FIG. 8A.
Figure 8A:
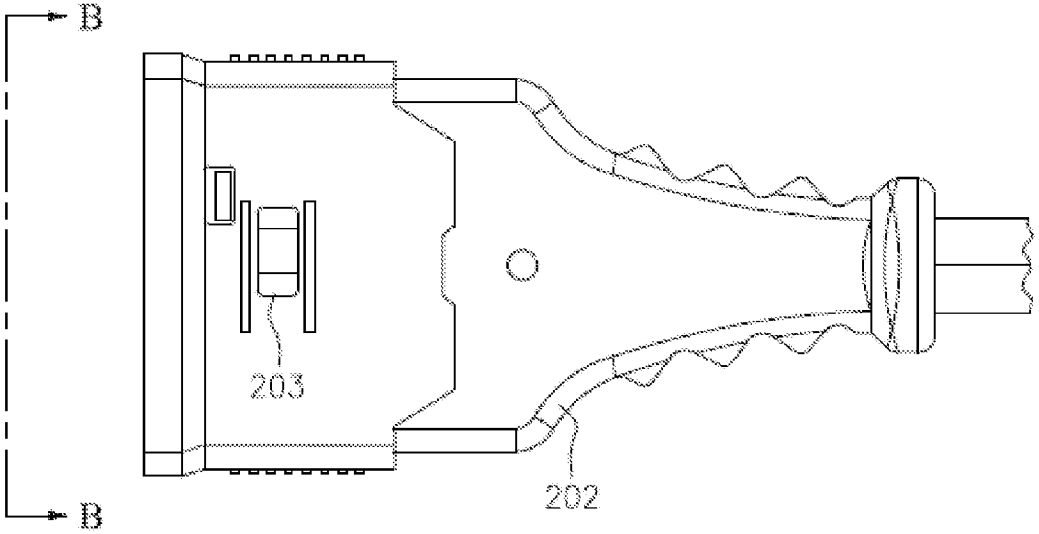
FIG. 8A is a side view of the male stage pin plug of the stage pin connector assembly of FIG. 3B.
Figure 9B:
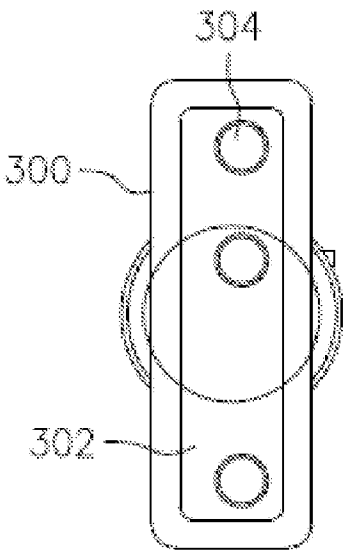
FIG. 9B is a top view of the female stage pin connector of FIG. 9A.
Figure 9A:
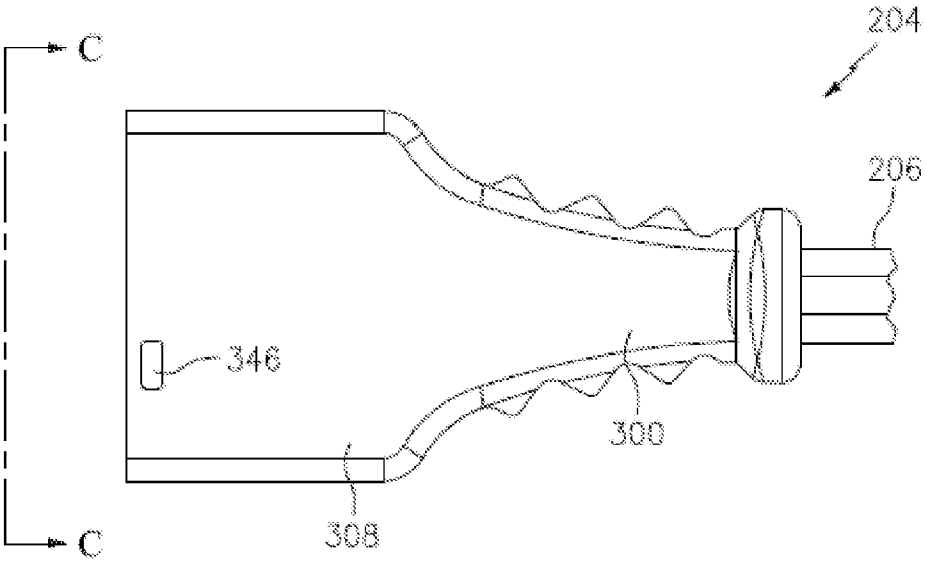
FIG. 9A is a side view of the female stage pin connector of the stage pin connector assembly of FIG. 3A.
Figure 9C:
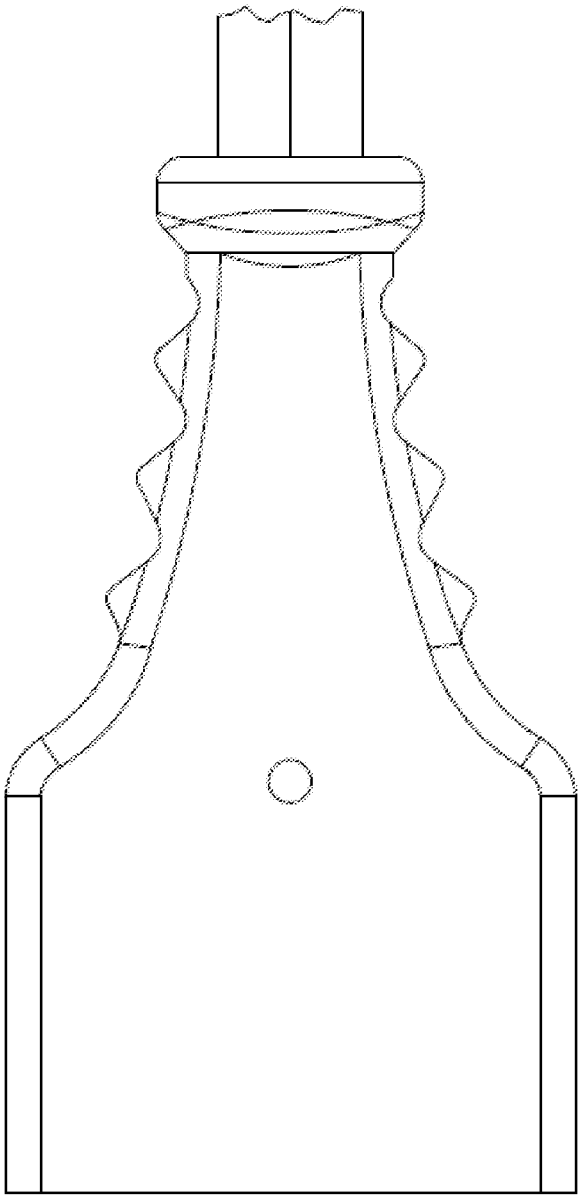
FIG. 9C is a side view of the female stage pin connector of FIG. 9A.
Figure 9D:
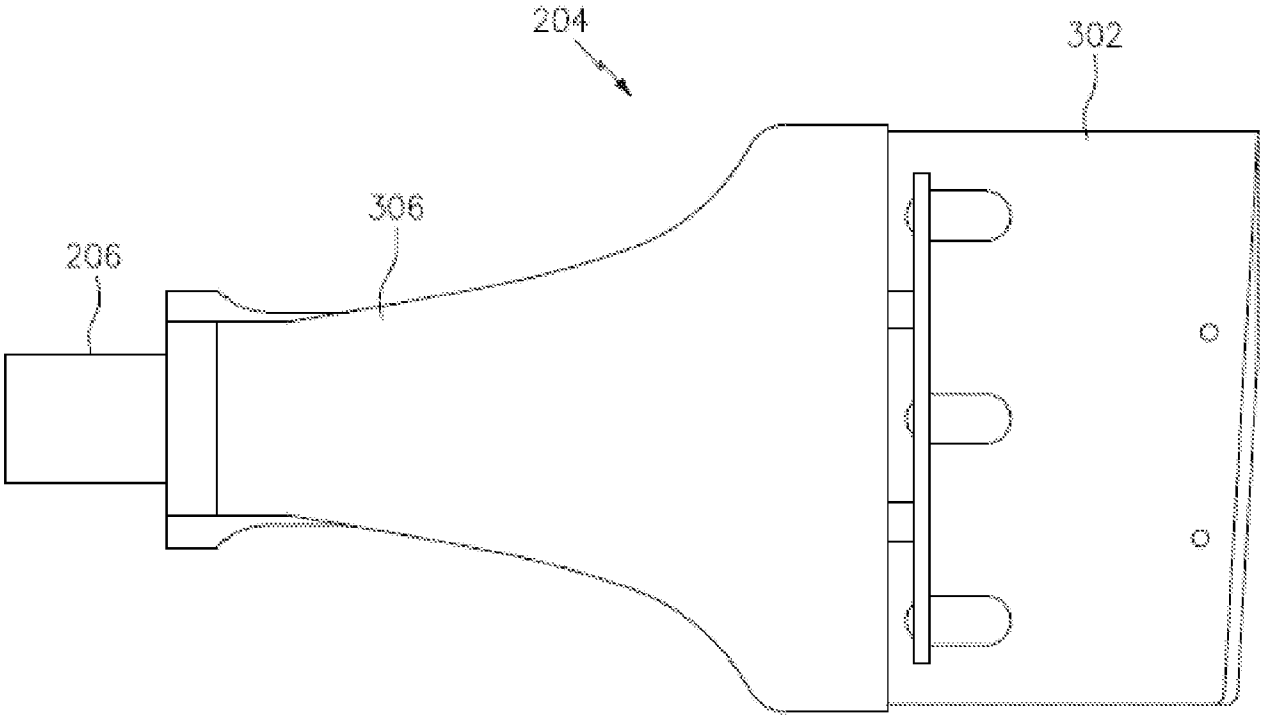
FIG. 9D is a side view of the female stage pin connector of FIG. 9A without the outer-mold component.

The connector locking member 292 includes a connector lock actuator 296 and a connector lock protrusion or tab 298, wherein the connector locking member 292 is movably associated with the shroud front 270 via the connector locking member opening such that the connector lock actuator 296 is configurable between an extended configuration (See FIG. 7C) and a compressed configuration (See FIG. 7D). When configured in the decompressed configuration, the connector lock actuator 296 is located away from the shroud front outer surface 270 and the connector lock tab 298 is not protruding into the shroud cavity 268 from (or protruding only slightly) the shroud front inner surface 280. When configured in the compressed configuration, the connector lock actuator 296 is located adjacent the shroud front outer surface 270 and the connector lock tab 298 is protruding away from the shroud front inner surface 280 into the shroud cavity 268. FIG. 8A and FIG. 8B show the male stage pin connector shroud 203 associated with the male stage pin connector 202. It should be appreciated that the connector shroud 203 may or may not be used. Moreover, it is also contemplated that the connector shroud 203 may be located on the female connector 204 rather than the male connector 202, as desired.

Referring to FIG. 9A, FIG. 9B, FIG. 9C and FIG. 9D, the female stage pin connector 204 is shown and may include a female connector housing 300 and a female contact carrier module 302 having a plurality of contact sockets 304. It should be appreciated that the female connector housing 300 may be constructed from a female pre-mold material 306 and a female outer-mold material 308, where the female pre-mold material 306 is configured to cover at least a portion of the female contact carrier module 302 and a portion of the cable assembly 206. The female outer-mold material 308 is configured to cover the female pre-mold material 306 and the female contact carrier module 302, where the end of the female contact carrier module 302 which includes the plurality of contact sockets 304 may be left uncovered by the female outer-mold material 308. It should be appreciated that although the female pre-mold material 306 and the female outer-mold material 308 are discussed herein as being molded materials, the female pre-mold material 306 and/or the female outer-mold material 308 may be replaced by covers/materials that are mechanically held together, such as by screws, clips, etc.

Figure 10A:
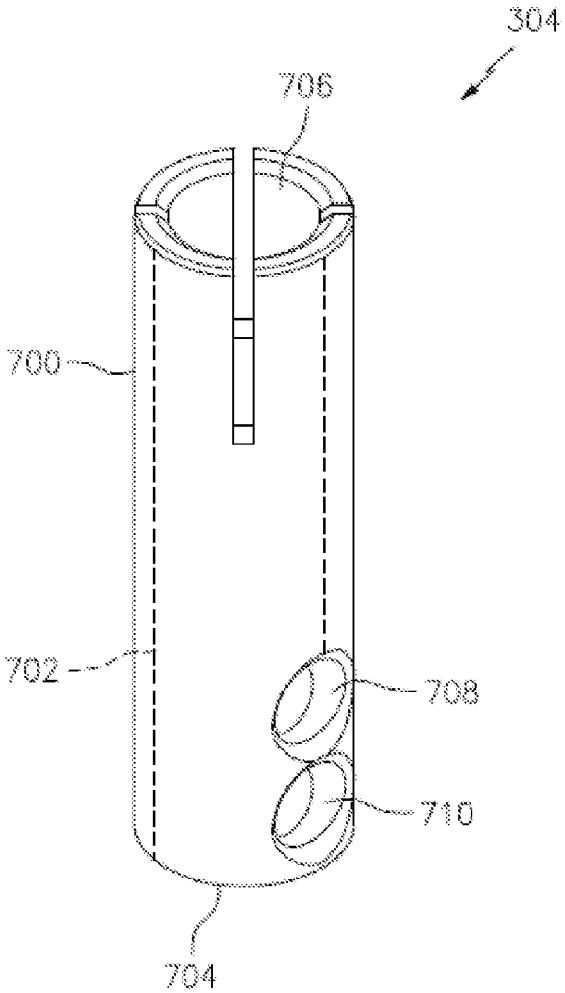
FIG. 10A is a side perspective view of a contact socket for use with the female connector housing of FIG. 9A.

Referring to FIG. 10A, one embodiment of a contact socket 304 is shown and includes a contact socket body 700, wherein the contact socket body 700 defines a contact socket body cavity 702 and includes a contact socket body bottom opening 704 and a contact socket body top opening 706, both of which are communicated with the contact socket body cavity 702. The contact socket body 700 further includes a first contact socket side opening 708 and a second contact socket side opening 710, each of which may be communicated with the contact socket body cavity 702, wherein the first and second contact socket side openings 708, 710 are threaded.

Referring to FIG. 10B, FIG. 10C, FIG. 10D and FIG. 10E, the female contact carrier module 302, in accordance with one embodiment of the invention, is shown and includes a female module body 310 having a female body top 312, a female body bottom 314, a female body front 316, a female body rear 318 and female body sides 320. The female body top 312 includes a female first top opening 322, a female second top opening 324 and a female third top opening 326. The female body bottom 314 includes a female first bottom opening 328, a female second bottom opening 330 and a female third bottom opening 332. The female module body 310 defines a female first cavity 334, a female second cavity 336 and a female third cavity 338, wherein the female first cavity 334 communicates the female first top opening 322 with the female first bottom opening 328, the female second cavity 336 communicates the female second top opening 324 with the female second bottom opening 330 and the female third cavity 338 communicates the female third top opening 326 with the female third bottom opening 332.

Figure 10B:
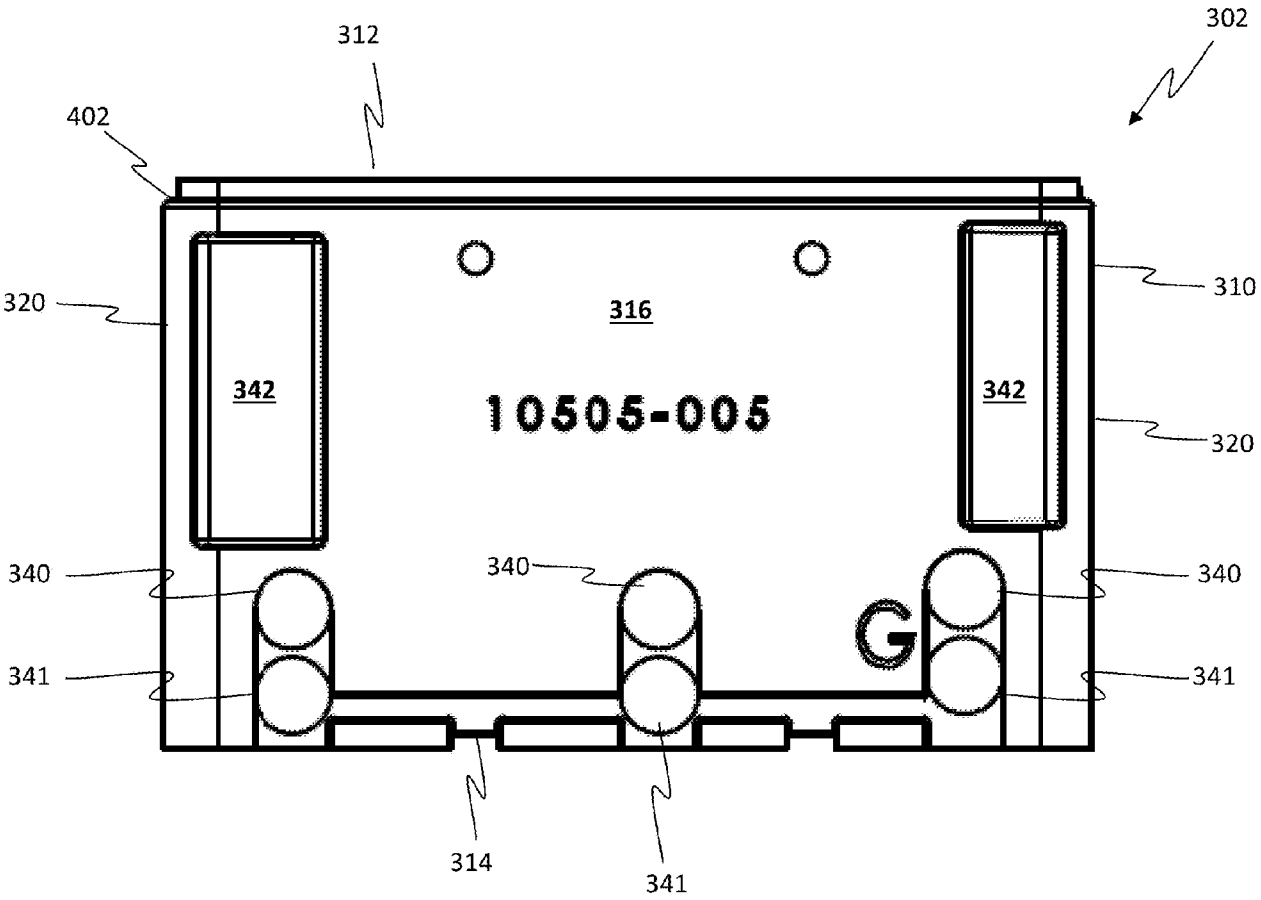
FIG. 10B is a side view of the female contact carrier module of the female stage pin connector of FIG. 9A.
Figure 10C:
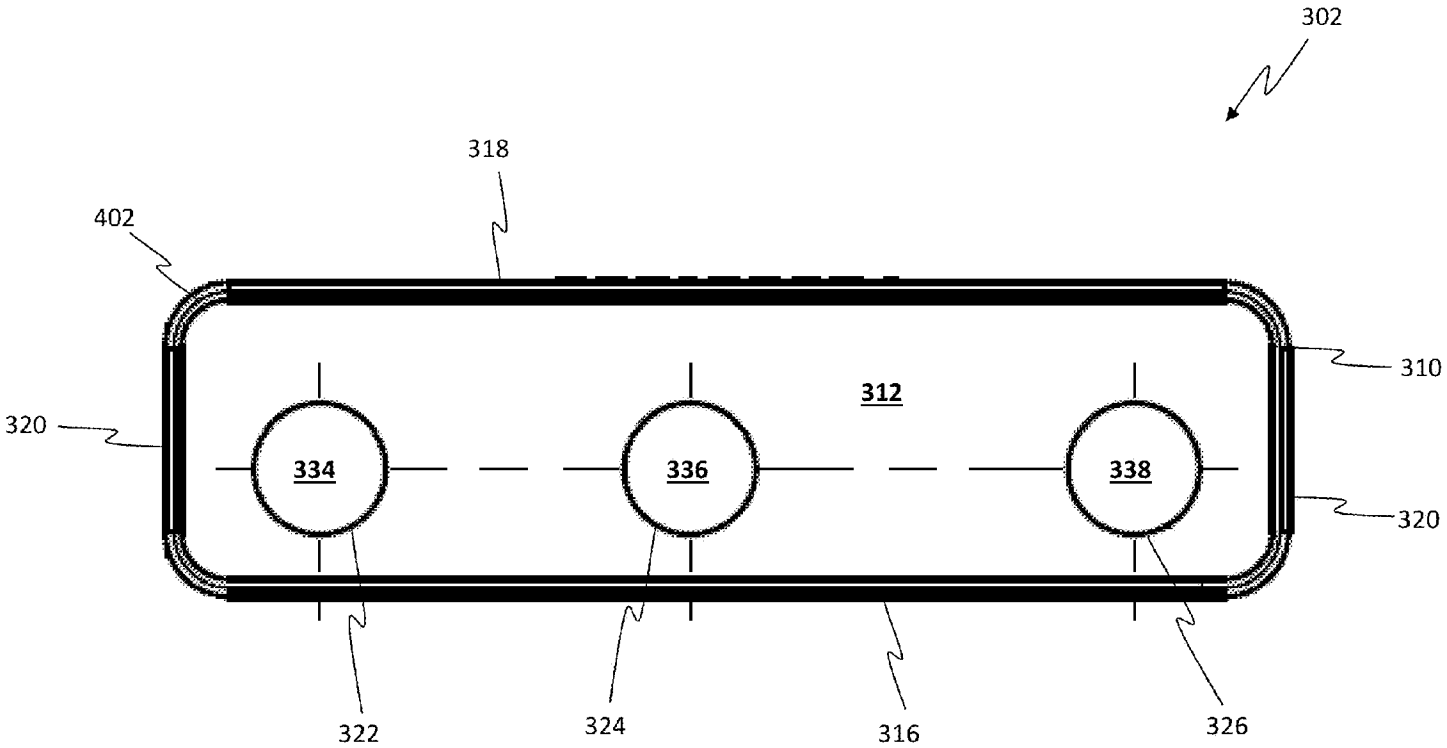
FIG. 10C is a top view of the female contact carrier module of FIG. 10A.
Figure 10D:
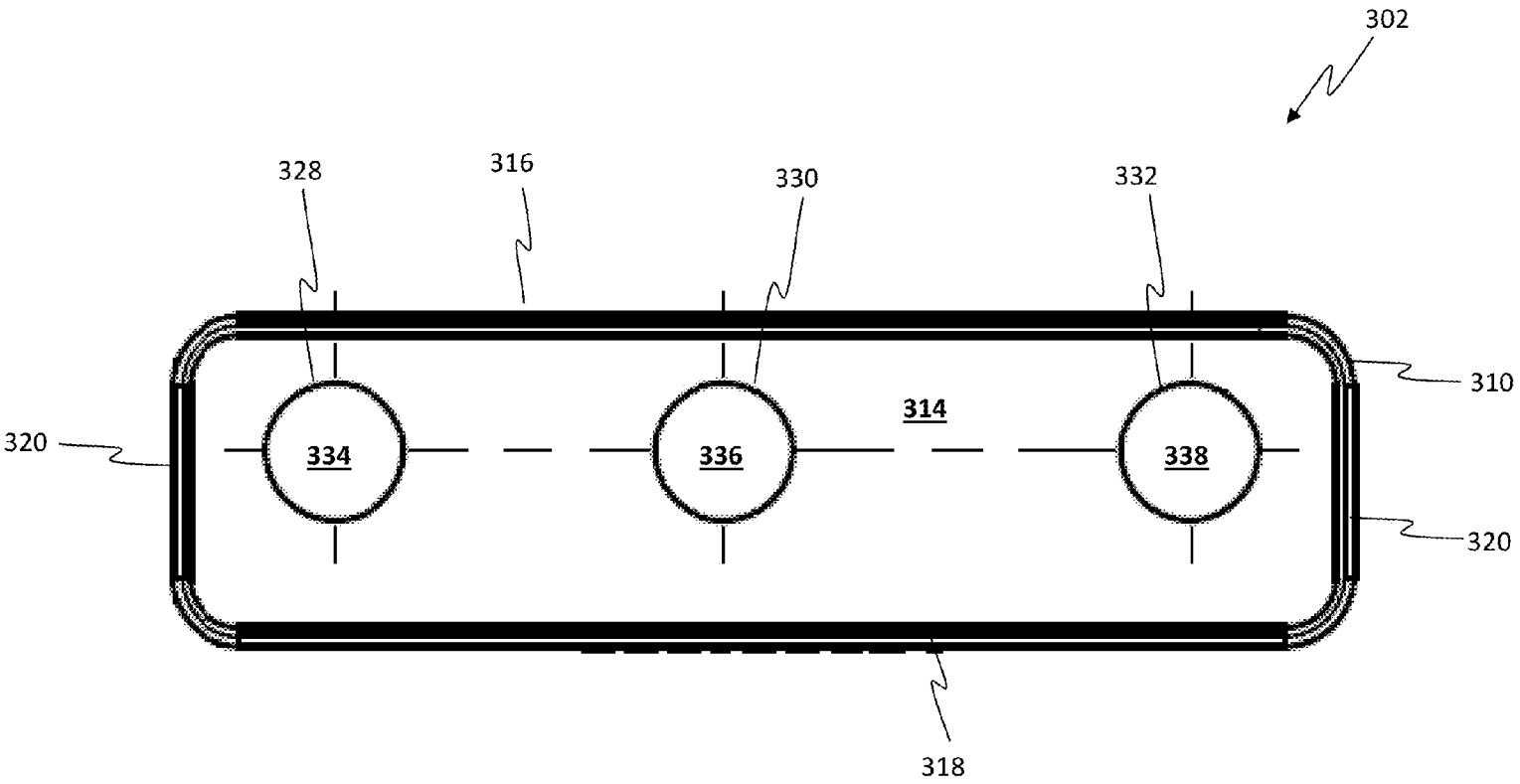
FIG. 10D is a bottom view of the female contact carrier module of FIG. 10A.
Figure 10E:
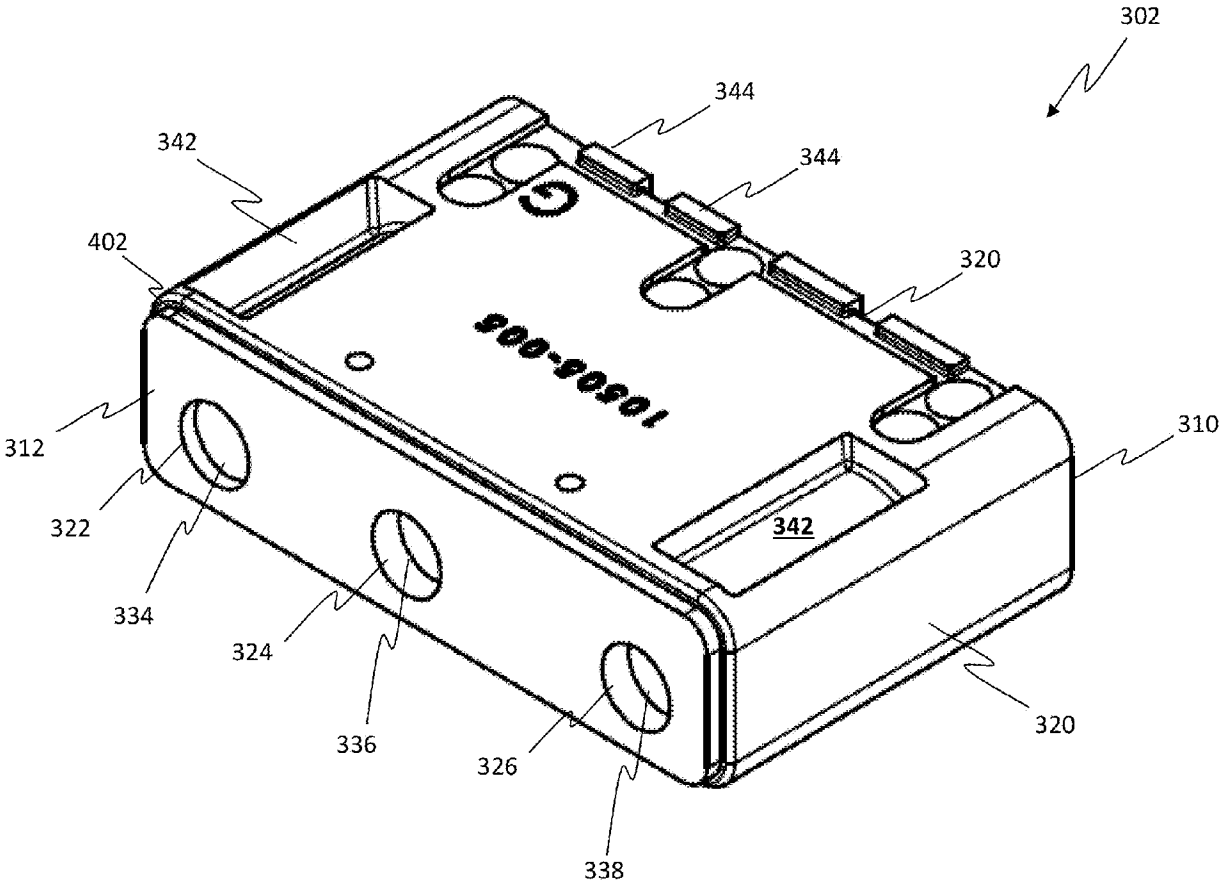
FIG. 10E is a side perspective view of the female contact carrier module of FIG. 10A.

Additionally, the female body front 316 includes a plurality of first female body side openings 340 and second female body side openings 341. Referring to FIG. 10B, one of the first female body side openings 340 and second female body side openings 341 is communicated with the female first cavity 334, another of the first female body side openings 340 and second female body side openings 341 is communicated with the female second cavity 336 and still yet another of the first female body side openings 340 and second female body side openings 341 is communicated with the female third cavity 338. As discussed further herein, the first and second female body side openings 340, 341 are located such that when a contact socket 304 is inserted into the female first cavity 334, female second cavity 336 and female third cavity 338, the first contact socket body side opening 708 and second contact socket body side opening 710 are aligned with the first and second female body side openings 340, 341, respectively. When a contact socket 304 is located within the female first cavity 334 such that the first contact socket body side opening 708 and second contact socket body side opening 710 is aligned with the first and second female body side openings 340, 341, the contact socket 304 is securely contained within the female first cavities 334 by inserting a screw into the first female body side opening 340 to engage the threaded portion of the first contact socket side opening 708.

Additionally, a screw is inserted into second female body side opening 341 to engage a threaded portion of the second contact socket body side opening 710. A conductor may be secured to the contact socket 304 by inserting the conductor into the contact socket body cavity 702 via the contact socket body bottom opening 704 to be aligned with at least one of the first contact socket body side opening 708 and second contact socket body side opening 710 and configuring the screw to extend into the contact socket body cavity 702 to compressingly engage a sleeve (such as a ferrule sleeve) which compresses against the conductor to contain the conductor within the contact socket body cavity 702. This is repeated for the remaining conductors. It should be appreciated that in accordance with the invention, other ways of securely containing the contact sockets 304 and/or cables/conductors within the cavities 334, 336 and 338 are contemplated, such as using set screws and/or press fitting (i.e. friction fit or threading the cavities) the contact sockets 304 and/or cables/conductors into the cavities 334, 336 and 338. Moreover, the first and second female body side openings 250, 251 may be threaded and the first contact socket body side opening 708 and a second contact socket body side opening 710 may be unthreaded (or they both may be threaded).

Referring again to FIG. 10D, it should be appreciated that the female module body 310 may also include one or more 'cored out' regions 253, cavities 342 and/or protrusions 344 located on the female body front 316, female body rear 318 and/or female body sides 320 to aid the female pre-mold material 306 and female outer-mold material 308 to more securely associate with the female module body 310. Furthermore, referring again to FIG. 9A, the female outer-mold material 308 includes a connector lock cavity 346 for interacting with the connector lock tab 298 when mated with a male stage pin connector 202 incorporating the male stage pin connector shroud 203.

Figure 11:
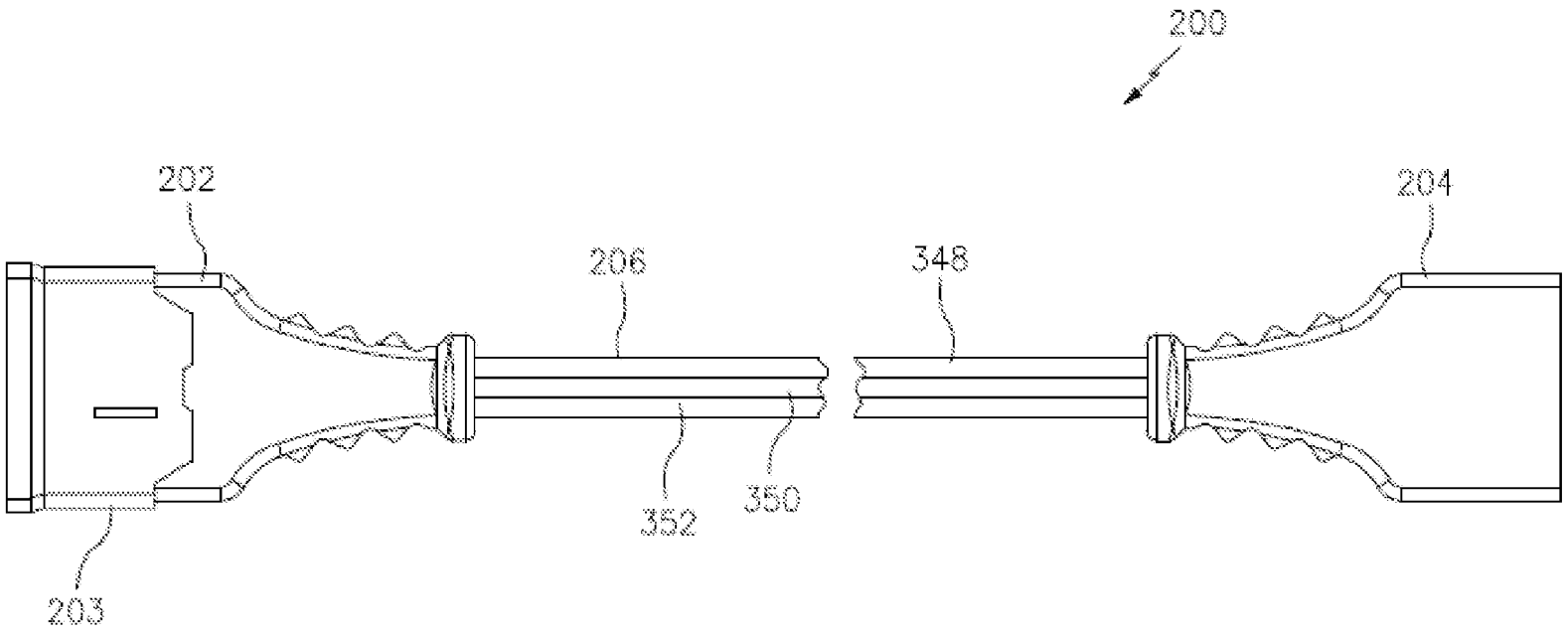
FIG. 11 is a side view of the stage pin connector assembly of FIG. 3A with a retractable shroud.
Figure 12:
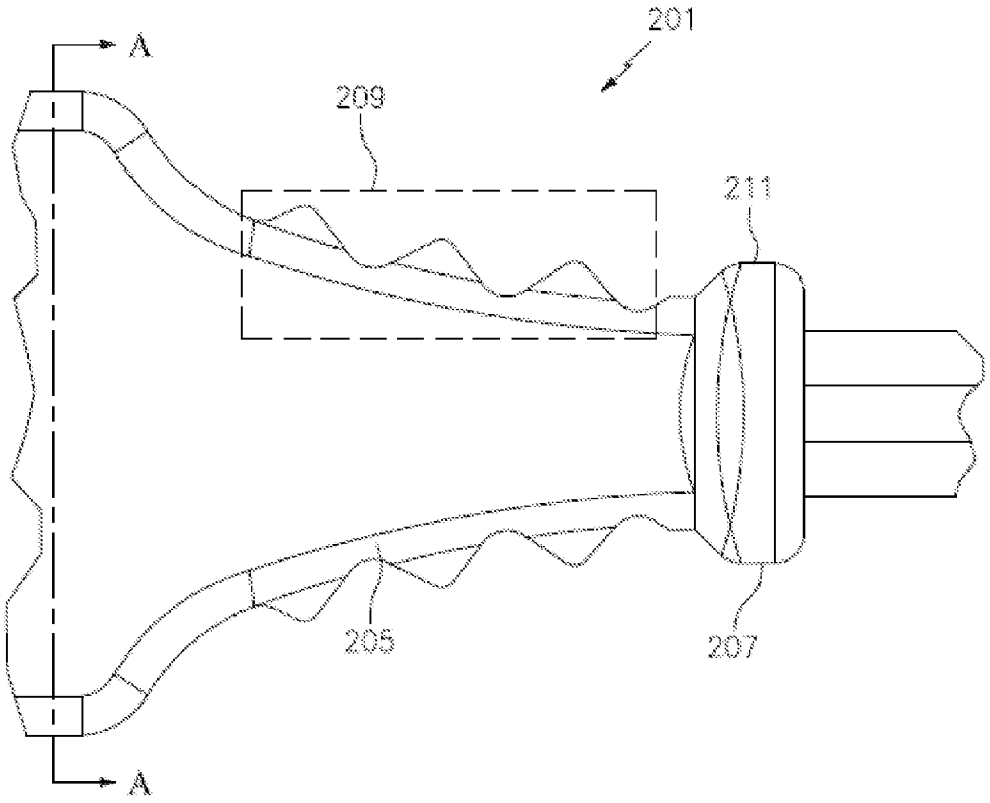
FIG. 12 is a side view of a stage pin connector showing the handle portion.
Figure 13:
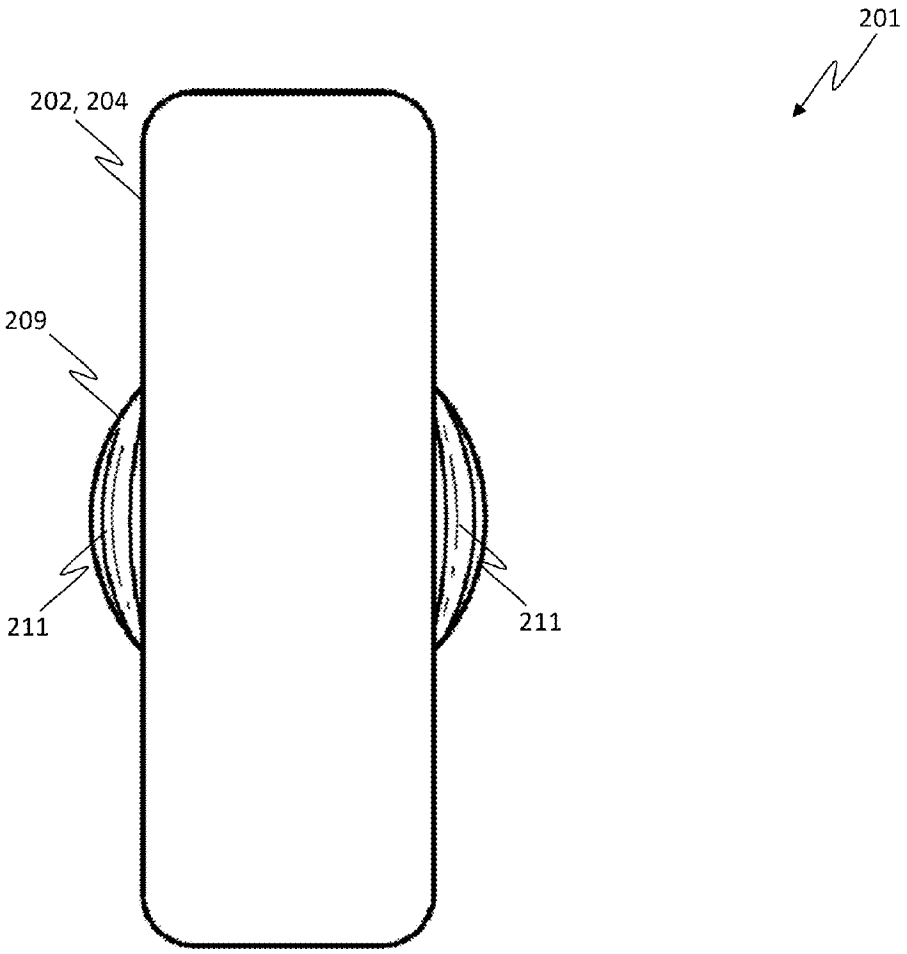
FIG. 13 is a top view of the stage pin connector of FIG. 12 with a retractable shroud.

Additionally, referring to FIG. 11, the cable conductor assembly 206 typically includes at least two circuit conductor cables 348 and 350, and a ground cable 352. However, it should be appreciated that the stage pin connector assembly 200 may be used for applications that use any amperes and may be modified and used for cable conductor assemblies 206 that include more or less cables/conductors, such as for example two cables or 4 cables. It is contemplated that the present invention may also be used with fiber optic cables as well. Accordingly, the number of contact pins 212 and contact sockets 304 may also be modified as the application requires and/or as desired.

It should be further appreciated that although the pre-mold material and/or the outer-mold material may be constructed from a, thermoset, thermoplastic and/or a thermoplastic elastomer (TPE) material, such as Santoprene® or some other synthetic rubber/polypropylene combination, it is contemplated that any material suitable to the desired end purpose may be used, such as a material that has an ergonomic, electrically insulating and/or structurally supporting property. For example, the outer-mold material 308 may be constructed using a hard plastic material. Moreover, the male contact carrier module 210, female contact carrier module 302 and/or male stage pin connector shroud 203 may be constructed from a thermoset material, a polycarbonate material and/or any other material or composite suitable to the desired end purpose. Moreover, it should be appreciated that although the connector assembly is disclosed herein with regards to stage pin connectors, it is contemplated that the invention may be applied to any type of connector assemblies that have protruding contacts or that are capable of being locked together.

Referring to FIGS. 3A-4A, FIG. 12 and FIG. 13, in one embodiment the male connector 202 and/or female connector 204 includes a handle portion 201 having a connector grip 205 and a connector knob 207, where the connector grip 205 is sized, shaped includes a contoured surface that has finger grooves/grip 209 to allow a user to better grip the connector during use and during connection and disconnection from an electrical component and/or a reciprocal connector. The connector knob 207 is located proximate the base of the connector where the outer-mold material 216 and/or the pre-mold material 214 meet the cable/conductors 206. The connector knob 207 is sized relative to the connector grip 205 such that a portion of the connector knob 207 forms a knob lip 211 of which a portion extends outward past the connector grip 205. As such, when a user is holding the connector 202, 204 by the connector grip 205, at least a portion of the side of the hand that is located between the pinky finger and the wrist contacts the knob lip 211. When a user pulls the connector 202, 204 in the direction of the connector knob 207 to disconnect the connector 202, 204 from a component or reciprocal connector, the users hand advantageously contacts and presses against the knob lip 211 thereby assisting with the disconnection of the connector 202, 204. Additionally, because the width of the connector knob 207 is greater than the base of the connector grip 205, the tendency of the pre-mold material and outer-mold material to peel is reduced or eliminated.

Figure 14A:
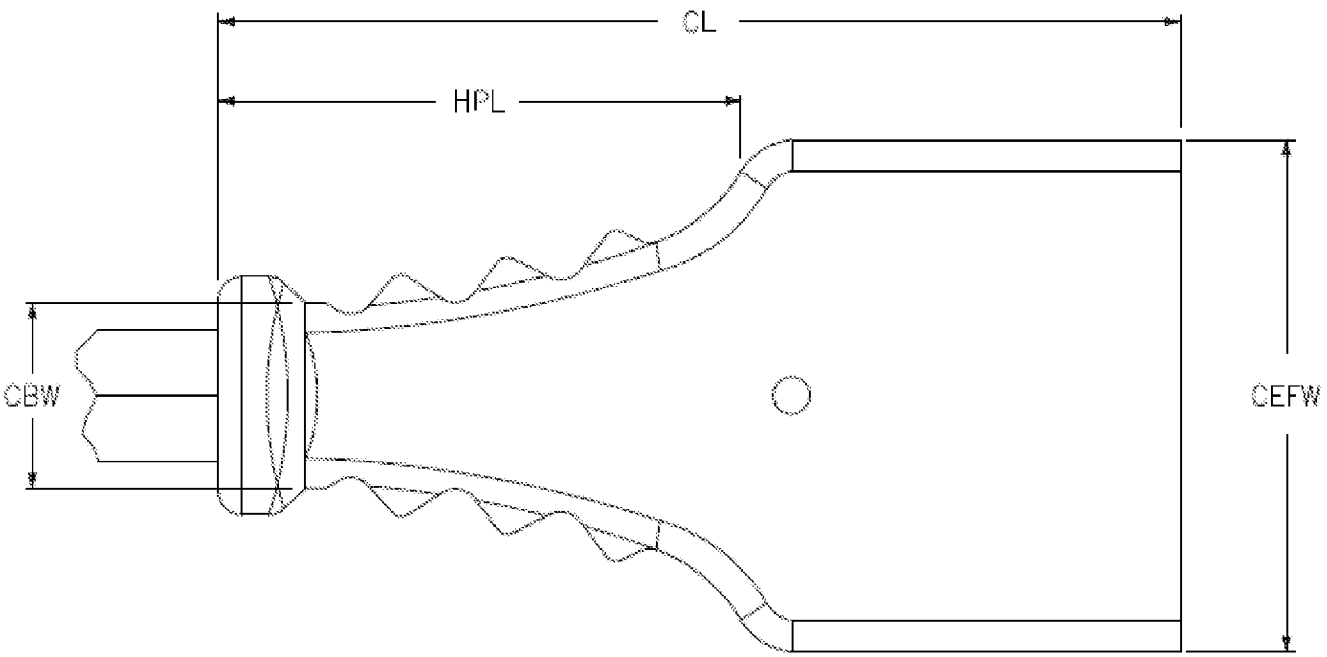
FIG. 14A is a side view of a stage pin connector of FIG. 12.
Figure 14C:
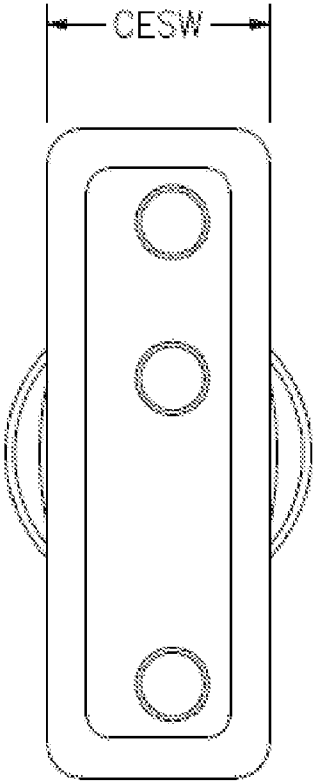
FIG. 14C is a top view of the stage pin assembly of FIG. 12.
Figure 14B:
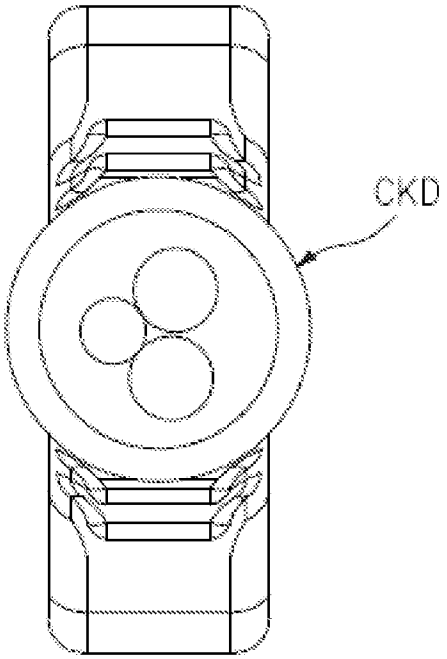
FIG. 14B is a bottom view of the stage pin connector of FIG. 12.

Although the male connect 202 and the female connector 204 may be of any size depending on desired application and/or design, FIG. 14A, FIG. 14B and FIG. 14C illustrates one embodiment of the size of the male connector 202 and the female connector 204 for use with 100 Amp, 125 Volt applications. The connector 202, 204 includes a Connector Length (CL), a Connector End First Width (CEFW), a Connector Base Width (CBW), a Handle Portion Length (HPL), a Connector End Second Width (CESW) and a Connector Knob (CKD). In this embodiment, appropriate sizes may be CL is about 7.72 inches (±10%), CEFW is about 4.19 inches (±10%), CBW is about 1.46 inches (±10%), HPL is about 4.33 inches (±10%), CESW is about 1.45 inches (±10%) and CKD is about 1.94 inches (±10%).

Figure 15A:
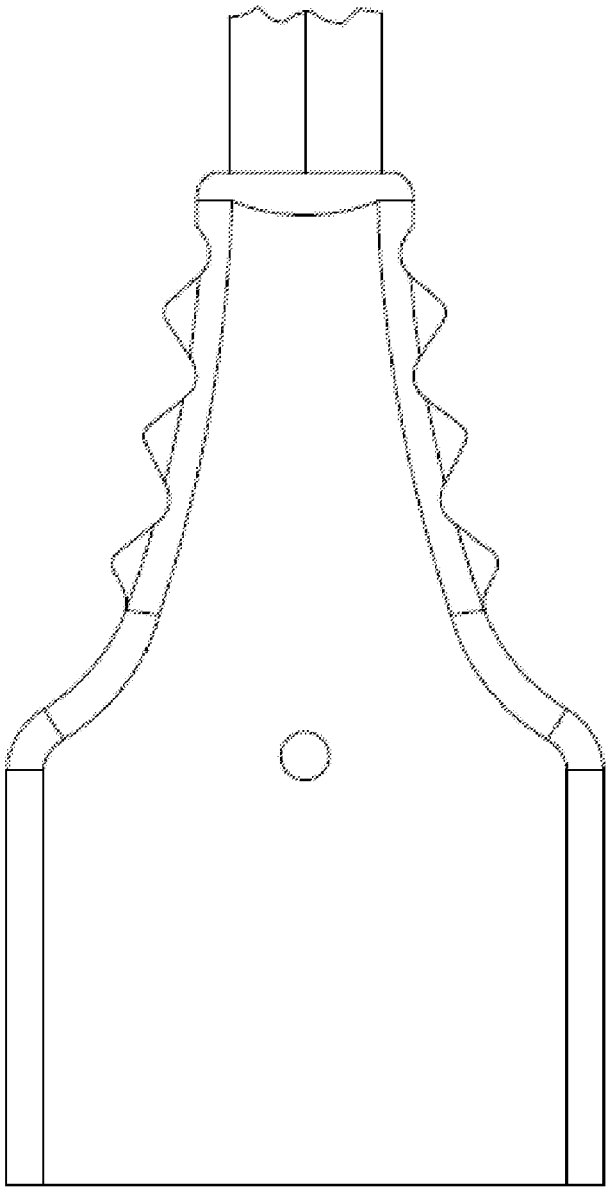
FIG. 15A is a side view of an electrical connector without a knob, in accordance with still yet another embodiment of the invention.
Figure 15B:
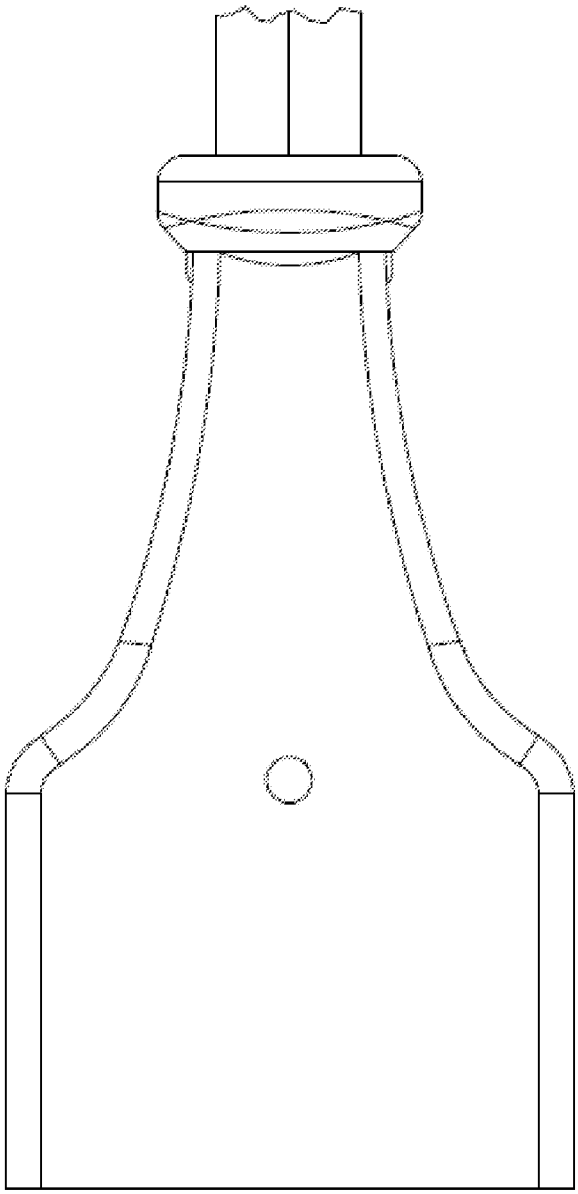
FIG. 15B is a side view of an electrical connector without finger grooves/grip, in accordance with still yet another embodiment of the invention.
Figure 15C:
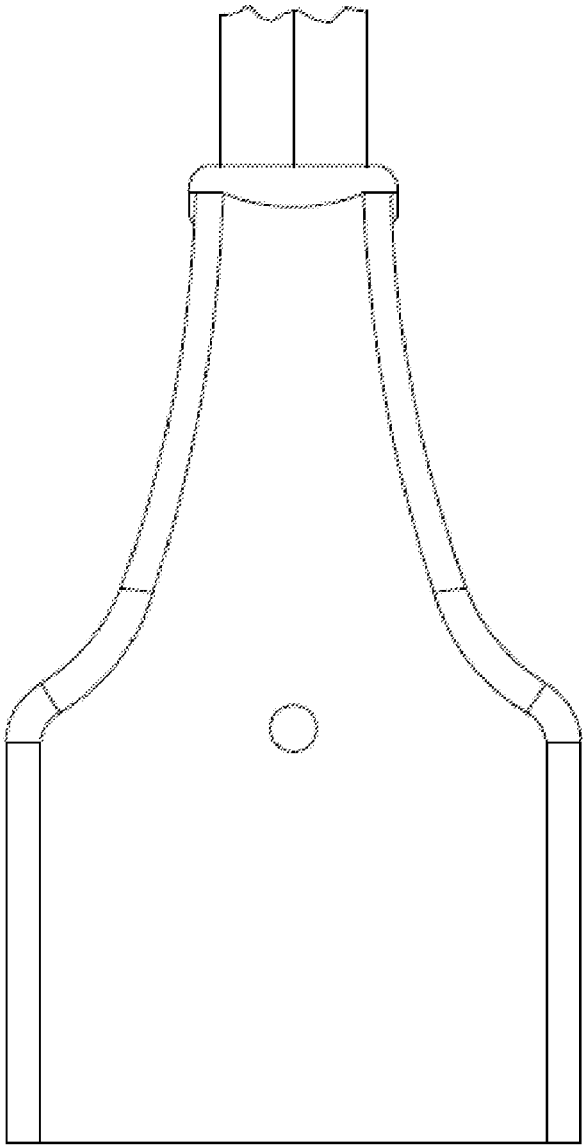
FIG. 15C is a side view of an electrical connector without finger grooves/grip or a knob, in accordance with still yet another embodiment of the invention.
Figure 15D:
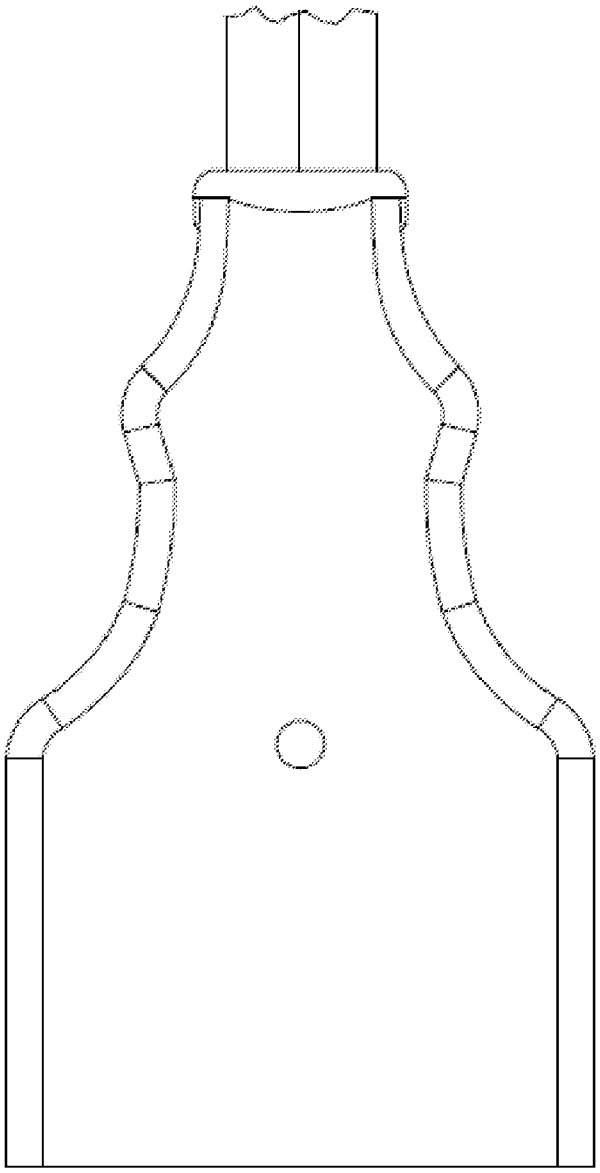
FIG. 15D is a side view of an electrical connector having a contoured portion that is contoured outward, in accordance with still yet another embodiment of the invention.
Figure 15E:
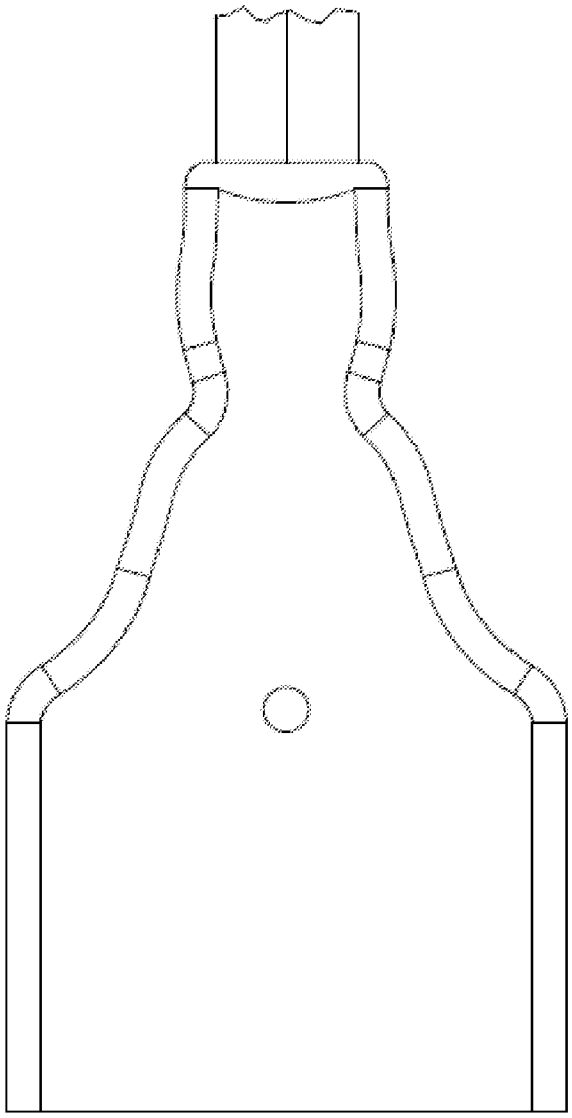
FIG. 15E is a side view of an electrical connector having a contoured portion that is contoured inward, in accordance with still yet another embodiment of the invention

It should be appreciated that in other embodiments, the finger grooves/grip 209 and/or the connector knob 207 may not be included. For example, in one embodiment the handle portion on the male connector 202 and/or female connector 207 may only include the finger grooves/grip 209 and not the connector knob 207 (See FIG. 15A). In another embodiment, the handle portion on the male connector 202 and/or female connector 207 may only include the connector knob 207 and not the finger grooves/grip 209 (See FIG. 15B). And in still yet another embodiment, the handle portion may not include either of the finger grooves/grip 209 and the connector knob 207 (See FIG. 15C). In still yet another embodiment, it is contemplated that the handle portion on the male connector 202 and/or female connector 207 may include a contoured portion to assist with gripping and pulling the connectors 202, 207. For example, the contoured portion may be contoured outward (See FIG. 15D) or inward (See FIG. 15E).

Figure 16:
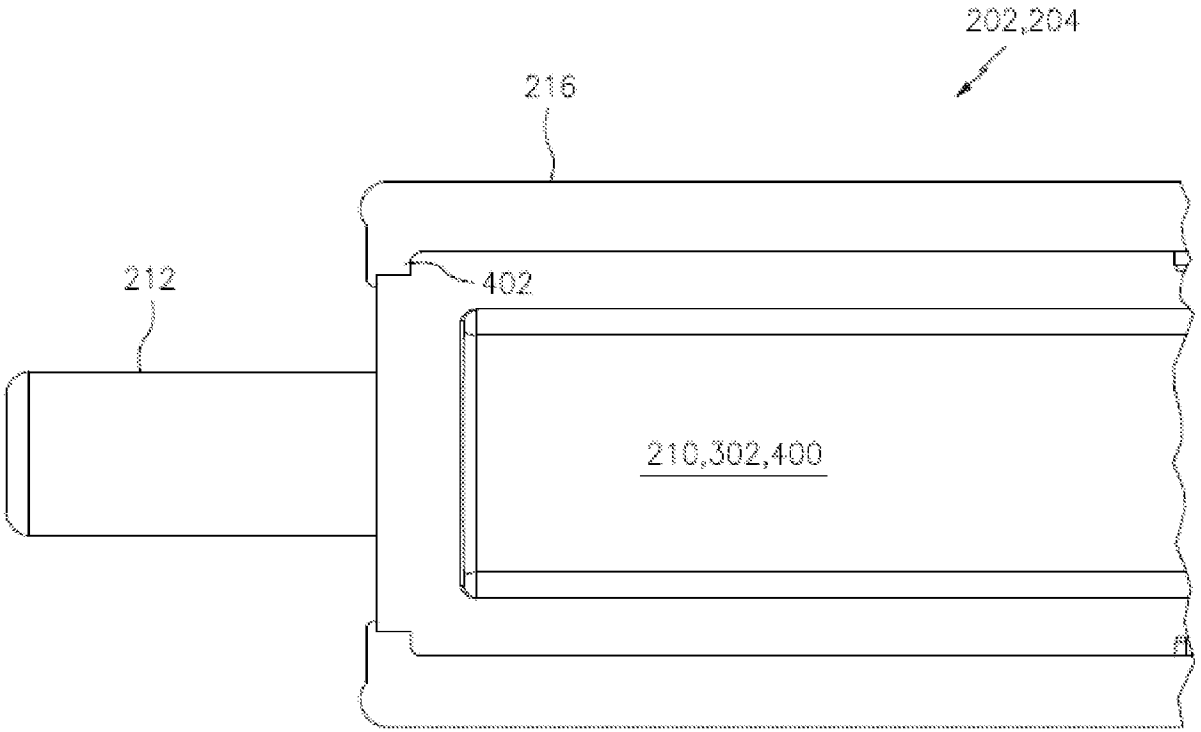
FIG. 16 is an exploded side sectional view of an electrical connector module having outer-mold material illustrating interaction of lip with over-mold material, in accordance with an embodiment of the invention.

Furthermore, it is contemplated that modules 210, 302, 400 may be molded or non-molded articles and may include 'cored out' regions 253 and cavities 255, 342 which may be created by and/or during the molding process (for molded modules), which may be part of the design or which may be created after the module is made (such as for non-molded modules). The pre-mold material 214 may then fill these 'cored out' regions 253 of the module 210, 302, 400. It should be appreciated that the filling of the 'cored out' regions 253 advantageously assists with the adherence of the pre-mold material to the module 210 and may help to increase the structural integrity of the module. Moreover, referring to FIG. 16 and again to FIGS. 5A-5H and FIGS. 10B-10E, the modules 210, 302, 400 may include a module top (and/or bottom)

lip 402 and at least one module pullback hole 403, wherein the module top lip 402 acts as a relief by providing the outer-mold material 216 a lip or shelf to adhere to and to finish substantially flush with the exposed contact carrier surface (i.e. body top 220, 312). It should be further appreciated that as the outer-mold material 216 is molded to the connector 202, 204, the outer-mold material 216 fills (at least partially) the at least one module pullback hole 403. This provides support to the outer-mold material 216 and advantageously helps the outer-mold material 216 to better bond to the module 210, 302, 400 and limit any "pullback" of the outer-mold material 216 from the module top lip 402 due to shrinking of the outer-mold material 216 during cooling.

Figure 17:
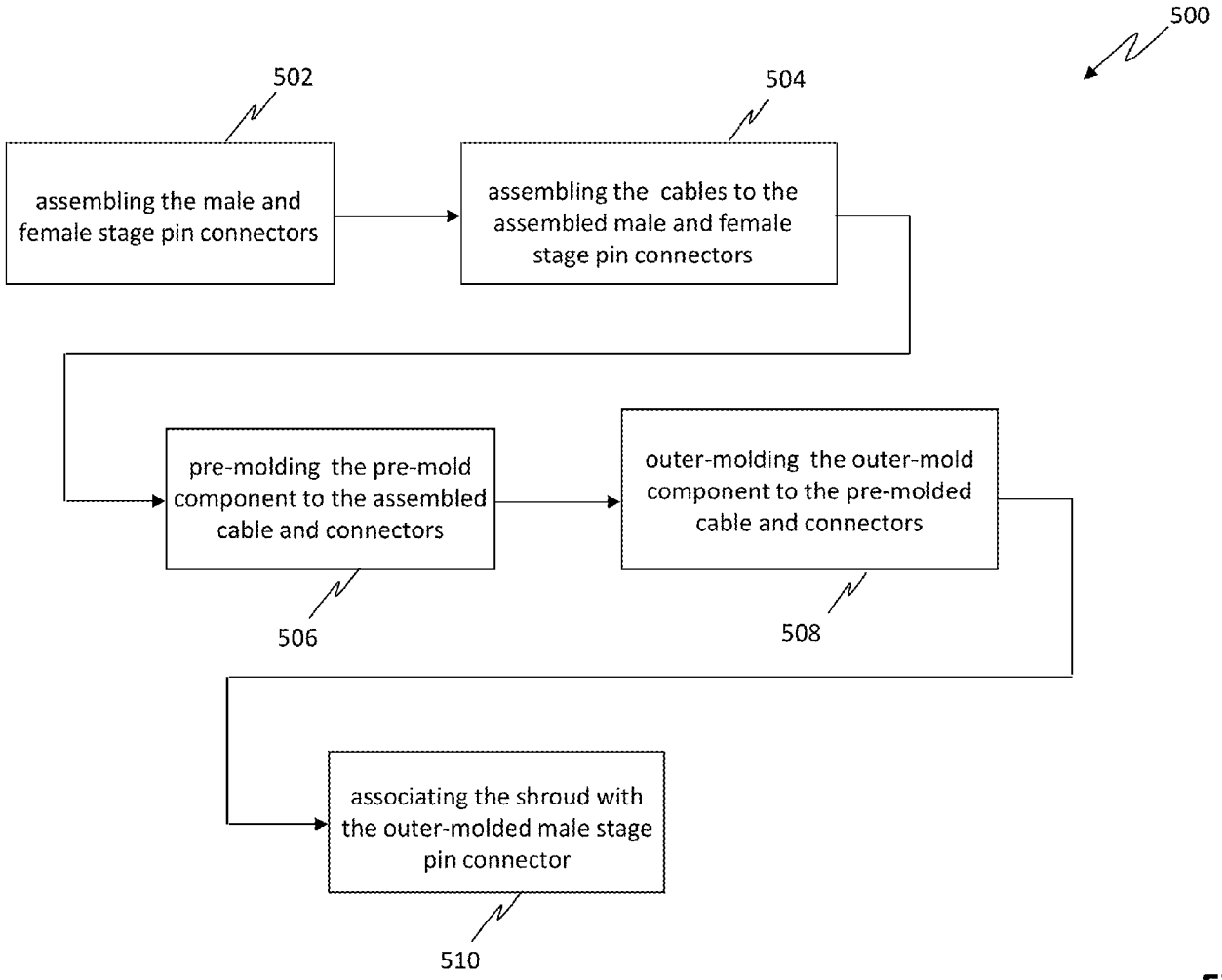
FIG. 17 is an operational block diagram illustrating one embodiment of a method 500 for assembling the stage pin connector assembly 200, in accordance with one embodiment of the present invention.

Referring to FIG. 17, an operational block diagram illustrating one embodiment of a method 500 for assembling the stage pin connector assembly 200 is provided and includes assembling the male stage pin connector 202 and the female stage pin connector 204, as shown in operational block 502. This may be accomplished as described herein above and/or as follows. The male stage pin connector 202 may be assembled by inserting a contact pin 212 into each of the male first cavity 242, the male second cavity 244 and the male third cavity 246. The contact pins 212 are then secured within the male first cavity 242, the male second cavity 244 and the male third cavity 246 by inserting screws into the openings 250 and tightening the screws so that they securingly engage the first contact pin body side opening 608 of the contact pins 212 contained in the male first cavity 242, the male second cavity 244 and the male third cavity 246. The female stage pin connector 204 may be assembled by inserting a contact socket 302 into each of the female first cavity 334, the female second cavity 336 and the female third cavity 338. The contact sockets 302 are then secured within the female first cavity 334, the female second cavity 336 and the female third cavity 338 by inserting screws into the openings 340 and tightening the screws so that they securingly engage the first contact socket body side opening 708 of the contact sockets 302 contained in the female first cavity 334, the female second cavity 336 and the female third cavity 338.

The cable assembly 206 is connected to the assembled male stage pin connector 202 and the assembled female stage pin connector 204, as shown in operational block 504. This may be accomplished by exposing the metal conductors on the ends of the power cable 348, the neutral cable 350 and the ground cable 352 of the cable assembly 206. A sleeve is associated with the metal conductor on one end of the circuit conductor cables 348 and 350 and the ground cable 352, which are then inserted into and secured within the male first cavity 242, the male second cavity 244 and the male third cavity 246, respectively. This may be accomplished by inserting screws into the openings 251 and the second contact pin body side opening 610 of the contact pins 212 and tightening the screws so that they securingly engage the metal conductors contained within the male first cavity 242, the male second cavity 244 and the male third cavity 246. The metal conductors on the other end of the power cable 348, the neutral cable 350 and the ground cable 352 are prepared as above and inserted into and secured within the female first cavity 334, the female second cavity 336 and the female third cavity 338, respectively. This may be accomplished by inserting screws into the openings 341 and the second contact socket body side opening 710 of the contact sockets 302 and tightening the screws so that they securingly engage the metal conductors contained within the female first cavity 334, the female second cavity 336 and the female third cavity 338.

When the cable assembly is connected to the assembled male stage pin connector 202 and the assembled female stage pin connector 204, a pre-mold material 214 is molded onto/into the assembled male stage pin connector 202 and the assembled female stage pin connector 204 assemblies, as shown in operational block 506. This may be accomplished by placing the assembled male stage pin connector 202 with the cables connected into a mold and associating a pre-mold component material with the assembled male stage pin connector 202 to cover a portion of the assembled male stage pin connector 202, the cable-pin connections and the cable proximate the male stage pin connector 202. Also, the assembled female stage pin connector 204 with the cables connected are also placed into a mold and a pre-mold component material is associated with the assembled female stage pin connector 204 to cover a portion of the assembled female stage pin connector 204, the cable-socket connections and the cable proximate the female stage pin connector 204.

When the pre-mold material 214 is associated with the male stage pin connector 202 and the assembled female stage pin connector 204, the molding process is repeated for the outer-mold material 216 to associate the outer-mold material 216 with the male stage pin connector 202 and the female stage pin connector 204, as shown in operational block 508. If desired, the male stage pin connector shroud 203 may then be associated with the male stage pin connector 202 as shown in operational block 510. This may be accomplished by placing the male stage pin connector shroud 203 over the male stage pin connector 202 such that the shroud front 270 is proximate the male body front 224 and the shroud rear 272 is proximate the male body rear 226 and such that front tab 285 is located in the shroud channel guide 254 on the male body front 224 and the rear tab 286 is located in the shroud channel guide 254 on the male body rear 226. Prior to locating the front and rear tabs 285, 286, a spring (or other resilient article) is placed in each of the shroud channel guides 254 to be located between the front and rear tabs 285, 286 and the bottom of the shroud channel guides 254. This advantageously bias's the male stage pin connector shroud 203 to be springingly associated with the male stage pin connector 202 such that when you push down on the male stage pin connector shroud 203, it springs back up to protect the contact pins 212. It should be appreciated that although the shroud channel guide 254 is discloses herein as being part of the contact carrier module, in yet another embodiment, the shroud channel guide 254 may be defined/formed by the outer-mold material or may be an add-on to the connector 202, 204.

Additionally, the male stage pin connector shroud 203 is associated with the male stage pin connector 202 such that the shroud pin 267 is located within the guide pin cavity 288 and the shroud lock tab 294 is located within the shroud lock guide channel 261. It should be appreciated that the connector locking member 292 is located such that when the male stage pin connector 202 is connected to a female stage pin connector 204, the connector lock tab 298 on the male stage pin connector shroud 203 is located proximate the connector lock cavity 346 on the female stage pin connector 204. Thus, when the connector locking member 292 is compressed (i.e. the compressed configuration) the connector lock tab 298 extends into the connector lock cavity 346 and the connectors are locked together. The connector locking member 292 is configured into the decompressed configuration by pulling the connector lock actuator away from the shroud front outer surface 270. This causes the connector lock tab 298 to be located away from the connector lock cavity 346 and the connectors may be separated.

It should also be appreciated that the male stage pin connector shroud 203 may be unlocked so that it freely moves or the male stage pin connector shroud 203 can be locked between a shroud lock first configuration and a shroud lock second configuration. The male stage pin connector shroud 203 can be locked in a shroud lock first configuration by compressing the male stage pin connector shroud 203 and sliding the locking switch finger actuator 291 such that the shroud lock tab 294 is located within the second lock channel 265. This locks the male stage pin connector shroud 203 so that the contact pins 212 are exposed. The male stage pin connector shroud 203 can be locked in a shroud lock second configuration by allowing the male stage pin connector shroud 203 to cover the contact pins and sliding the locking switch finger actuator 291 such that the shroud lock tab 294 is located within the first lock channel 263. This locks the male stage pin connector shroud 203 so that the contact pins 212 are covered by the male stage pin connector shroud 203.

It is contemplated that, if desired, the connectors 202, 204 of the present invention may also be constructed without using a pre-mold material. In this case, only the over-mold material would be used to construct the connectors 202, 204. As such, the construction of the connectors 202, 204 would be the same as above, but without the pre-mold step.

Moreover, the connectors 202, 204 may be constructed from any materials or combination of materials as desired and suitable to the desired end purpose. For example, in one embodiment the male contact carrier module 210 and female contact carrier module 302 may be constructed from a thermoset Bulk Molding Compound (BMC) which is resistant to charring and burning and the pre-mold material may be constructed from a thermoplastic material and the over-mold material may be constructed from a thermoplastic elastomer (TPE), such as Santoprene® which is a mixture of in-situ cross linking of EPDM rubber and polypropylene.

It should be appreciated that while the invention has been described with reference to an exemplary embodiment, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A Stage Pin connector, wherein the State Pin connector includes a connector top and a connector base, comprising, a contact carrier module, wherein the contact carrier module defines a first module cavity, a second module cavity and a third module cavity and includes a first module top opening communicated with a first module bottom opening via the first module cavity, a second module top opening communicated with a second module bottom opening via the second module cavity and a third module top opening communicated with a third module bottom opening via the third module cavity;

a first electrical conductor, a second electrical conductor and a third electrical conductor, wherein the first electrical conductor is located within the first module cavity to be communicated with the first module top opening and the first module bottom opening, the second electrical conductor is located within the second module cavity to be communicated with the second module top opening and the second module bottom opening and the third electrical conductor is located within the third module cavity to be communicated with the third module top opening and the third module bottom opening;

a plurality of electrical cables each having a cable conductor, wherein each of the cable conductors is in electrical communication with at least one of the first electrical conductor, second electrical conductor and third electrical conductor via at least one of the first module bottom opening, second module bottom opening and third module bottom opening; and a connector housing, wherein the connector housing includes an outer-mold material, wherein the outer-mold material covers at least a portion of the plurality of electrical cables and the contact carrier module, such that the first module top opening, second module top opening and third module top opening are uncovered.

2. The Stage Pin connector of claim 1, further comprising a pre-mold material, wherein the pre-mold material is located under the outer-mold material and is configured to cover at least a portion of the contact carrier module and at least a portion of the plurality of the electrical cables.

3. The Stage Pin connector of claim 2, wherein at least one of the pre-mold material and the outer-mold material form a connector knob located proximate the connector base and the plurality of electrical cables.

4. The Stage Pin connector of claim 1, wherein the contact carrier module is configured as at least one of a male contact carrier module and a female contact carrier module.

5. The Stage Pin connector of claim 4, wherein when the contact module carrier is configured as a male contact carrier module, the first electrical conductor, the second electrical conductor and the third electrical conductor are male contact pins that extend out of the contact carrier module; and when the contact module carrier is configured as a female contact carrier module, the first electrical conductor, the second electrical conductor and the third electrical conductor are female contact sockets that define a contact socket body cavity configured to receive the male contact pin.

6. The Stage Pin connector of claim 1, wherein the cable conductors include a first cable conductor, a second cable conductor and a third cable conductor, wherein the first cable conductor, second cable conductor and third cable conductor are compressingly secured to the first electrical conductor, second electrical conductor and third electrical conductor, respectively.

7. The Stage Pin connector of claim 2, wherein the pre-mold material is configured to cover the connection of the first cable conductor to the first electrical conductor, the second cable conductor to the second electrical conductor and the third cable conductor to the third electrical conductor, such that the connection of the first cable conductor to the first electrical conductor, the second cable conductor to the second electrical conductor and the third cable conductor to the third electrical conductor is isolated from an external environment.

8. The Stage Pin connector of claim 2, wherein the contact carrier module includes at least one 'cored out' portion and wherein at least one of the pre-mold material and the outer-mold material is configured to at least partially fill in the 'cored out' portion.

9. The Stage Pin connector of claim 3, wherein the connector base has a connector base width (CBW) and the connector knob has a connector knob diameter (CKD), wherein the connector knob diameter (CKD) is larger in size than the connector base width (CBW).

10. The Stage Pin connector of claim 9, wherein the connector base width (CBW) is about 1.46 inches (±10%) and the connector knob diameter (CKD) is about 1.94 inches (±10%).

11. The Stage Pin connector of claim 1, wherein the contact carrier module is constructed from a thermoset BMC material, polymer material, the pre-mold material is constructed from a thermoplastic material and the over-mold material is constructed from a thermoplastic elastomer (TPE) material.

12. The Stage Pin connector of claim 1, further comprising a handle portion, wherein the handle portion includes finger grooves/grips.

13. The Stage Pin connector of claim 1, further comprising a shroud which is configured to extend past the connector top.

14. The Stage Pin connector of claim 13, wherein the shroud is movably associated with the connector to be configurable between a shroud first configuration and a shroud second configuration, wherein when in the shroud first configuration, the first, second and third electrical conductors are exposed, and when in the shroud second configuration, the first, second and third electrical conductors are at least partially covered.

15. An electrical connector, wherein the electrical connector includes a connector top and a connector base, the electrical connector comprising, a contact carrier module, wherein the contact carrier module defines a module cavity and includes a module top opening communicated with a module bottom opening via the module cavity;

a electrical conductor located within the module cavity to be communicated with the module top opening and the module bottom opening; and a connector housing, wherein the connector housing includes an outer-mold material, wherein the outer-mold material covers the contact carrier module, such that the module top opening is uncovered, wherein the connector housing forms a handle portion located proximate the connector base.

16. The electrical connector of claim 15, further comprising a pre-mold material, wherein the pre-mold material is located under the outer-mold material and is configured to cover at least a portion of the contact carrier module.

17. The electrical connector of claim 16, wherein at least one of the pre-mold material and the outer-mold material form a connector knob located proximate the connector base.

18. The electrical connector of claim 15, further comprising an electrical cable having a cable conductor, wherein the cable conductor is in electrical communication with the electrical conductor via the module bottom opening.

19. The electrical connector of claim 15, wherein the contact carrier module is configured as at least one of a male contact carrier module and a female contact carrier module.

20. The electrical connector of claim 19, wherein when the contact module carrier is configured as a male contact carrier module, the electrical conductor is a male contact pin that extends out of the contact carrier module; and when the contact module carrier is configured as a female contact carrier module, the electrical conductor is a female contact socket that defines a contact socket body cavity configured to receive the male contact pin.

21. The electrical connector of claim 20, wherein the cable conductor is compressingly secured to the electrical conductor via a sleeve and a mounting screw.

22. The electrical connector of claim 18, wherein the pre-mold material is configured to cover a portion of the contact carrier module and a portion of the electrical cable to cover the connection of the cable conductor to the electrical conductor, such that the connection of the cable conductor to the electrical conductor is isolated from an external environment.

23. The electrical connector of claim 17, wherein the connector base has a connector base width (CBW) and the connector knob has a connector knob diameter (CKD), wherein the connector knob diameter (CKD) is larger in size than the connector base width (CBW).

24. The electrical connector of claim 16, wherein the contact carrier module is constructed from a thermoset BMC material, the pre-mold material is constructed from a thermoplastic material and the over-mold material is constructed from a thermoplastic elastomer (TPE) material.

25. The electrical connector of claim 15, wherein the handle portion includes finger grooves/grips.

26. The electrical connector of claim 15, further comprising a shroud which is configured to extend past the connector top.

27. The electrical connector of claim 26, wherein the shroud is movably associated with the connector to be configurable between a shroud first configuration and a shroud second configuration, wherein when in the shroud first configuration, the electrical conductor is exposed, and when in the shroud second configuration, the electrical conductor is at least partially covered.

28. An electrical connector, comprising, a contact carrier module, wherein the contact carrier module defines a module cavity and includes a module top opening communicated with a module bottom opening via the module cavity;

a electrical conductor located within the module cavity to be communicated with the module top opening and the module bottom opening;

an electrical cable having a cable conductor, wherein the cable conductor is in electrical contact with the electrical conductor via the module bottom opening; and a connector housing, wherein the connector housing includes a pre-mold material and an outer-mold material, wherein the pre-mold material covers at least a portion of the contact carrier module and at least a portion of the electrical cable, and the outer-mold material covers the pre-mold material and the contact carrier module, such that the module top opening is uncovered, wherein the connector housing forms a connector knob located proximate the electrical cable.

29. The electrical connector of claim 24, further comprising a connector base proximate the connector knob, wherein the connector base has a connector base width (CBW) and the connector knob has a connector knob diameter (CKD), wherein the connector knob diameter (CKD) is larger in size than the connector base width (CBW).

30. The electrical connector of claim 28, further comprising a shroud which is configured to extend past the connector top.

31. The electrical connector of claim 30, wherein the shroud is movably associated with the connector to be configurable between a shroud first configuration and a shroud second configuration, wherein when in the shroud first configuration, the electrical conductor is exposed, and when in the shroud second configuration, the electrical conductor is at least partially covered.

* * * * *